US008840103B2

(12) United States Patent
Fukumoto et al.

(10) Patent No.: US 8,840,103 B2
(45) Date of Patent: Sep. 23, 2014

(54) SHEET CONVEYING DEVICE AND IMAGE FORMING APPARATUS

(71) Applicants: Takashi Fukumoto, Kanagawa (JP); Mamoru Kambayashi, Tokyo (JP); Michitaka Suzuki, Kanagawa (JP); Atsushi Fujita, Kanagawa (JP); Masataka Fukuchi, Kanagawa (JP); Ryuji Yoshida, Kanagawa (JP); Hideki Tobinaga, Kanagawa (JP); Norio Kimura, Kanagawa (JP); Kenichiro Morita, Tokyo (JP); Koki Sakano, Kanagawa (JP); Takuya Sano, Kanagawa (JP); Takuya Morinaga, Tokyo (JP); Takashi Nakano, Kanagawa (JP)

(72) Inventors: Takashi Fukumoto, Kanagawa (JP); Mamoru Kambayashi, Tokyo (JP); Michitaka Suzuki, Kanagawa (JP); Atsushi Fujita, Kanagawa (JP); Masataka Fukuchi, Kanagawa (JP); Ryuji Yoshida, Kanagawa (JP); Hideki Tobinaga, Kanagawa (JP); Norio Kimura, Kanagawa (JP); Kenichiro Morita, Tokyo (JP); Koki Sakano, Kanagawa (JP); Takuya Sano, Kanagawa (JP); Takuya Morinaga, Tokyo (JP); Takashi Nakano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/028,848

(22) Filed: Sep. 17, 2013

(65) Prior Publication Data

US 2014/0084531 A1 Mar. 27, 2014

(30) Foreign Application Priority Data

Sep. 26, 2012 (JP) ..... 2012-212650

(51) Int. Cl.

*B65H 5/00* (2006.01)
*B65H 3/06* (2006.01)
*B65H 5/02* (2006.01)

(52) U.S. Cl.

CPC . *B65H 3/06* (2013.01); *B65H 5/021* (2013.01)
USPC ..... 271/10.1; 271/4.01; 271/6; 271/4.04; 271/4.06; 271/4.07; 271/4.08; 271/4.09; 271/10.01; 271/10.04; 271/10.06; 271/10.07; 271/10.08; 271/10.09; 271/4.1; 271/34; 271/124; 271/125; 271/267; 271/268

(58) Field of Classification Search

CPC ..... B65H 3/46; B65H 5/025; B65H 5/026; G03G 15/6558; G03G 2215/00409
USPC ..... 271/4.01, 6, 4.04, 4.06, 4.07, 4.08, 271/4.09, 4.1, 10.01, 10.04, 10.06, 10.07, 271/10.08, 10.09, 10.1, 34, 124, 125, 267, 271/268
See application file for complete search history.

(56) References Cited

U.S. PATENT DOCUMENTS

| | | | | |
|---|---|---|---|---|
| 4,523,832 | A * | 6/1985 | Strutt et al. | 399/388 |
| 2002/0195766 | A1* | 12/2002 | Sekine | 271/34 |
| 2007/0264063 | A1 | 11/2007 | Sano et al. | |
| 2007/0278734 | A1* | 12/2007 | Yoshida | 271/124 |
| 2008/0308995 | A1 | 12/2008 | Tobinaga et al. | |
| 2010/0027081 | A1 | 2/2010 | Sano et al. | |
| 2010/0225045 | A1 | 9/2010 | Kimura et al. | |
| 2010/0225983 | A1 | 9/2010 | Fujii et al. | |
| 2011/0304092 | A1* | 12/2011 | Kambayashi et al. | 271/4.02 |
| 2012/0002252 | A1 | 1/2012 | Kubo et al. | |
| 2012/0057212 | A1 | 3/2012 | Tobinaga et al. | |
| 2012/0119432 | A1 | 5/2012 | Kambayashi et al. | |
| 2012/0119436 | A1 | 5/2012 | Morita et al. | |
| 2012/0236375 | A1 | 9/2012 | Fujita et al. | |
| 2012/0314267 | A1 | 12/2012 | Suzuki et al. | |

* cited by examiner

FOREIGN PATENT DOCUMENTS

JP 2002-347960 12/2002

OTHER PUBLICATIONS

U.S. Appl. No. 13/768,270, filed Feb. 15, 2013.

*Primary Examiner* — Prasad Gokhale
(74) *Attorney, Agent, or Firm* — Harness, Dickey & Pierce, P.L.C.

(57) ABSTRACT

A sheet conveying device includes: a separation sheet feeding mechanism having a paper feeding belt and a separation roller; and an adjustment mechanism that changes contact state of the paper feeding belt to the separation roller by changing relative position of the paper feeding belt and the separation roller, and changes and adjusts separation performance of the separation roller for the subsequent sheet, wherein the adjustment mechanism includes a cam follower member changing the relative position of the feeding belt and the separation roller, the cam member includes a first cam face and a second cam face which are formed at each rotation radius position in accordance with the rotation angle position, and are spaced apart in the rotation radius direction, and the cam follower member has a contact unit guided by the first cam face and the second cam face.

10 Claims, 10 Drawing Sheets

SHEET CONVEYING DEVICE AND IMAGE FORMING APPARATUS

CROSS-REFERENCE TO RELATED APPLICATIONS

The present application claims priority to and incorporates by reference the entire contents of Japanese Patent Application No. 2012-212650 filed in Japan on Sep. 26, 2012.

BACKGROUND OF THE INVENTION

1. Field of the Invention

The present invention relates to a sheet conveying device and an image forming apparatus, and more particularly, a sheet conveying device suitable for a document conveying device for conveying a document sheet to a scanning position of an image reading device at a conveying speed at which the image can be read, and relates to an image forming apparatus using the sheet conveying device.

2. Description of the Related Art

In the past, a sheet conveying device serving as a document conveying device capable of separating each sheet from a bundle of cut sheet-like document sheets, and continuously feeding the sheet to an image scanning position of an image forming apparatus such as a copier, a facsimile machine, and the like, is well known. In this kind of sheet conveying device, a known sheet conveying device is one having a paper feeding belt and a separation roller used in a mechanism for separating a document sheet from the document bundle and pressing a holding in which a paper feeding belt is set in a direct manner or with a link mechanism so as to change a separation pressure which is set by a contact angle (nip angle) of a nip portion between the paper feeding belt and the separation roller.

For example, Japanese Patent No. 4152604 discloses a mechanism for releasing pressure of a paper feeding belt while preventing skew and adjusting a contact angle at a nip portion of a separation roller using a pair of cams provided in a proximity of the paper feeding belt so as to allow adjustment of the contact angle of the nip portion between a paper feeding belt and the separation roller using this pressure release mechanism.

However, in such sheet feeding device and image forming apparatus capable of feeding sheets continuously as described above, the separation pressure which is set by the contact angle of the nip portion of the paper feeding belt and the separation roller of the separation feeding device can be changed and set, but the contact angle at the nip portion of the paper feeding belt and the separation roller thus set cannot be accurately maintained while the sheets are being passed. For this reason, the contact angle of the nip portion of the paper feeding belt and the separation roller may change while the sheets are fed, and there is a problem in that the separation pressure may change.

Accordingly, the present invention is to provide a sheet conveying device and an image forming apparatus capable of appropriately holding a contact angle of a nip portion of the paper feeding belt and the separation roller during separation of sheets and obtaining preferable separation pressure at all times.

SUMMARY OF THE INVENTION

It is an object of the present invention to at least partially solve the problems in the conventional technology.

According to an aspect of the invention, a sheet conveying device is provided. The sheet conveying device includes: a separation sheet feeding mechanism having a paper feeding belt and a separation roller, wherein when there are not only a sheet which is in contact with the paper feeding belt and is to be fed but also a subsequent sheet in contact with the separation roller, the separation sheet feeding mechanism uses the feeding belt to feed the sheet which is to be fed, and uses the separation roller to separate the subsequent sheet from the sheet which is to be fed; and an adjustment mechanism that changes contact state of the paper feeding belt to the separation roller by changing relative position of the paper feeding belt and the separation roller, and changes and adjusts separation performance of the separation roller for the subsequent sheet, wherein the adjustment mechanism includes a cam follower member changing the relative position of the feeding belt and the separation roller in accordance with the rotation angle position of the cam member and the rotating cam member, the cam member includes a first cam face and a second cam face which are formed at each rotation radius position in accordance with the rotation angle position, and are spaced apart in the rotation radius direction, and the cam follower member has a contact unit guided by the first cam face and the second cam face to a lift position in accordance with a rotation angle position of the cam member from both sides in the rotation radius direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12A is a partially enlarged perspective view illustrating connection state of a paper feeding belt holder bracket of a separation pressure adjustment mechanism and a cam member driving it in a separation pressure adjustment direction in the digital MFP according to an embodiment of the present invention, wherein FIG. 12A illustrates the connection state which is seen from a direction different from FIG. 8A; and FIG. 12B is a partially enlarged perspective view illustrating a state where the separation sheet feeding mechanism and the driving mechanism at the cam member side are separated, wherein FIG. 12B illustrates the state which is seen from a direction different from FIG. 8B.

DETAILED DESCRIPTION OF THE PREFERRED EMBODIMENTS

Hereinafter, a preferred embodiment of the present invention will be explained with reference to drawings.

Embodiment

FIGS. 1 to 12 illustrate a configuration of an automatic sheet conveying device of a sheet through method according to an embodiment of a sheet conveying device of the present invention. The present embodiment is implemented, as a document conveying device for automatically conveying cut sheet-like documents, on a digital MFP having the functions of a digital copier, a printer, a facsimile machine, and a scanner, which are image forming apparatuses.

Figure 1:
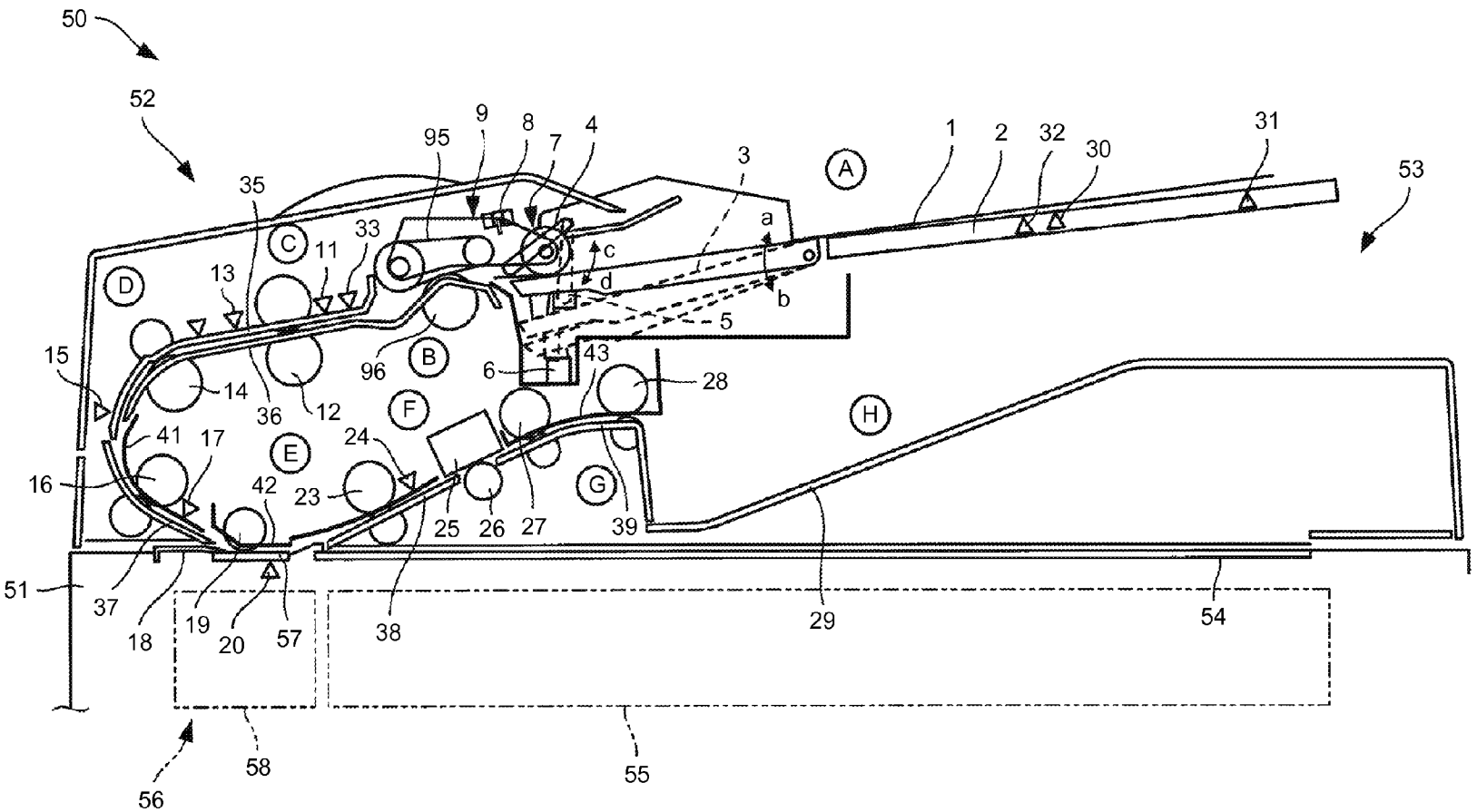
FIG. 1 is a relevant portion front side cross sectional configuration diagram illustrating a sheet conveying device of the present invention and a digital MFP using the sheet conveying device according to an embodiment of an image forming apparatus.

As illustrated in FIG. 1, a digital MFP 50 (image forming apparatus) includes a document pressing unit 53 having a document conveying device 52 integrally provided on an image forming apparatus main body 51, and the document pressing unit 53 is configured to be able to open and close by being coupled with an upper portion of the back side of the image forming apparatus main body 51 with a hinge.

The image forming apparatus main body 51 includes a placed document image scanning unit 55 having contact glass 54 at the upper side thereof and a first conveyed document image scanning unit 56 located at a side of the placed document image scanning unit 55, which are not shown in details.

Then, when a document image is ready by the placed document image scanning unit 55 or first conveyed document image scanning unit 56, the digital MFP 50 executes well-known electrophotographic image forming processing based on the image data, and can record (print) the scanned image onto a predetermined recording sheet and transfer/output an image file.

The image forming apparatus main body 51 of the digital MFP 50 uses a main body control unit 111 provided therein to control operation of the placed document image scanning unit 55, the first conveyed document image scanning unit 56, and the like, and can form, for example, an electrostatic latent image on a photosensitive drum, not shown, based on a scanned document image provided by the placed document image scanning unit 55, develop the electrostatic latent image using toner, and record an image by transferring and fixing the toner image onto a predetermined recording sheet.

The placed document image scanning unit 55 exposes and scans the lower face of the document on the contact glass 54 in the main scanning and the sub-scanning direction, and achieves the functions of a well-known flatbed scanner for reading the document image.

The first conveyed document image scanning unit 56 achieves the functions of a well-known DF scanner for reading an image on the front face side of the document which is automatically being conveyed.

The first conveyed document image scanning unit 56 includes a slit glass 57 and a front face scanning unit 58. the slit glass 57 is for reading a front face image arranged at a side of the contact glass 54 in parallel therewith. When the switched-back document sheet is conveyed in the sub-scanning direction at a predetermined speed while passing the scanning position 20 on the slit glass 57, the document image on the front face is scanned by the front face scanning unit 58 in the main scanning direction from the lower side, as in the figure, through the slit glass 57.

Hereinafter, the configuration of the document conveying device 52 which is an embodiment of a sheet conveying device of the present invention will be explained.

As illustrated in the front side cross sectional configuration diagram illustrating the schematic configuration thereof in FIG. 1, the document conveying device 52 of the present embodiment includes, as multiple function units arranged along the document feed path (sheet passage path), a document set unit A, a separation feeding unit B, a registration unit C, a turn unit D, a first scan conveying unit E, a second scan conveying unit F, a discharging unit G, and a stack unit H.

The document set unit A is in a shape of a document set base on which at least one cut sheet-like document, which is to be read, such as a bundle of multiple documents to be read (hereinafter simply referred to as document bundle) can be placed, and the document to be read bundle is configured to be set thereon at a position where the sheets can be fed in such a manner that one of the document faces such as the front face which is the scanned face in a case of a single sided original (hereinafter simply referred to as front face) is at the upper side.

The separation feeding unit B separates the uppermost document from the document bundles set on the document set unit A, and feeds the separated document into an entrance of a document conveying path.

The registration unit C has a function of adjusting the documents successively fed from the separation feeding unit B into a predetermined conveying posture with primary abutment, and also has a function of pulling and conveying the aligned document to a downstream side.

The turn unit D has a reverse conveying function for reversing the document so that the front face thereof is at the lower side in FIG. 1, by switching back and conveying, in a U-turn like manner, the document pulled out and conveyed by the registration unit C.

The first scan conveying unit E conveys the document 1, which has been switched back and conveyed from the turn unit D, at a predetermined speed in the sub-scanning direction while conveys the document 1 over the scanning position 20 on the slit glass 57.

When the document 1 is a both-sided document, the second scan conveying unit F scans the back face image of the document at a downstream side with respect to the main scanning position of the front face image through platen glass for reading back face image, not illustrated, in the main scanning direction from the diagonally upper side in FIG. 1, and also conveys the document in the sub-scanning direction at a predetermined speed.

The discharging unit G discharges, to the stack unit H, the document 1 which has been read by the first scan conveying unit E and the second scan conveying unit F.

The stack unit H successively stacks the documents 1, which are successively discharged from the discharging unit G, in such a manner that the front face thereof is at the lower side, and as a result, the sheet bundle of the documents 1 is stacked in the same order in which the pages are arranged when the sheet bundle is set on the document set unit A but, in terms of the entire sheet bundle, the direction of the document face is upside down.

Figure 2:
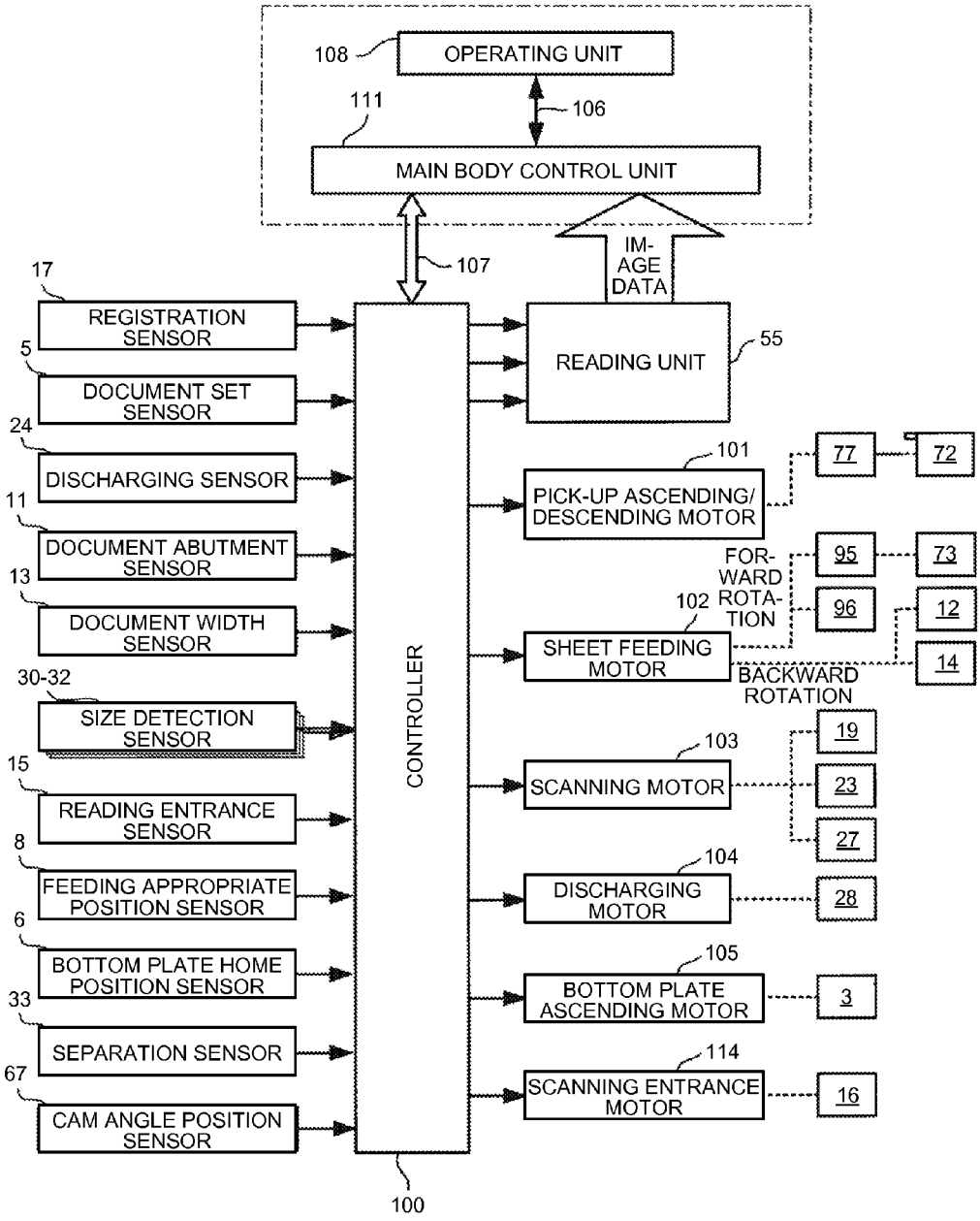
FIG. 2 is a block diagram illustrating a configuration of a control system of the digital MFP according to an embodiment of the present invention.

More specifically, As illustrated in FIGS. 1 and 2, the document set unit A includes a document table 2 on which the document 1 is set, a movable table 3 arranged at a front side portion, in the document conveying direction, of the document table 2 so as to be able to swing in the vertical direction, a set detection feeler 4 that can swing and comes into contact with the document 1 when the document 1 is set on the document table 2, a document set sensor 5 for detecting that the set detection feeler 4 swings to the upper side, and a home position sensor 6 for detecting that the movable table 3 swings to a home position at the most descended side.

In this case, on the document table 2, at least one sheet, for example, a sheet bundle-like document 1 carrying multiple document sheets is set in such a manner that the document image face is at the upper side. The movable table 3 is configured to move in the vertical direction as illustrated by arrows a, b in FIG. 1 by a bottom plate ascending motor 105 (see FIG. 2). The movable table 3 opens the entrance portion of the separation feeding unit B by swinging to the most descended position when the document is set on the document table 2, and when the document has been set on the document table 2, the movable table 3 supports the lower face of the leading end of the document 1 at the entrance portion of the separation feeding unit B at a height corresponding to the number of stacked sheets of the document 1. When the document 1 is set on the document table 2, the set detection feeler 4 is pivoted and manipulated to the upper side by the document 1, and when the set detection feeler 4 swings the upper side, the document set sensor 5 detects the set detection feeler 4, and detects that the document 1 is set on the document table 2 in an indirect manner.

Both sides of the document 1 in a width direction perpendicular to the document conveying direction are positioned and guided by a movable guide member, not illustrated. When the leading end portion of the document 1 is inserted into the entrance portion of the separation feeding unit B opened, the set detection feeler 4 and the document set sensor 5 detect that the document 1 has been set, and this is transmitted via an interface circuit 107 to the main body control unit 111.

In a proximity of the document stacking surface of the document table 2, size detection sensors 30, 31, 32 are provided to detect the document size by identifying the end position of the document. The size detection sensors 30 to 32 may be a reflection-type sensor for performing detection without coming into contact with the document using optical means and a contacting actuator-type sensor capable of detecting even one sheet. The size detection sensors 30 to 32 are arranged to be able to detect whether the arrangement of the document is in the vertical direction or in the horizontal direction.

From the separation feeding unit B to the discharging unit G, multiple conveying guides 35, 36, 37, 38, 39, 41, 42, 43 are provided to guide the conveyed document to the predetermined feed path.

The separation feeding unit B includes upstream side portions of the multiple conveying guides 35, 36, a pick-up mechanism 7 capable of calling and conveying, in the document conveying direction, the uppermost document from the documents 1 placed on the document table 2, a feeding appropriate position sensor 8 for detecting whether an appropriate height (feeding appropriate position) maintained or not at which the uppermost document of the documents 1 raised by the movable table 3 is in contact with the pick-up mechanism 7, and a separation sheet feeding mechanism 9 for separating, from the other document sheets, one of the document sheets of the uppermost documents called and conveyed by a pick-up roller 73.

As illustrated in FIGS. 4 to 7, the pick-up mechanism 7 includes a rotation driving shaft 71 serving as a pick-up driving shaft, a pick-up bracket 72 supported by the rotation driving shaft 71 and capable of swinging in the vertical direction, the pick-up roller 73 rotatably supported on the rotation driving shaft 71 with the pick-up bracket 72 in parallel thereto, toothed wheels 74*a*, 74*b*, pulleys 75*a*, 75*b*, and an endless belt 76 for rotation motion transmission interposed between the rotation driving shaft 71 and the pick-up roller 73. In this case, the rotation driving shaft 71 receives, as pick-up driving rotation, forward direction rotation given by a sheet feeding motor 102 as separation sheet feeding driving source.

The separation sheet feeding mechanism 9 includes a rotation driving shaft 71 serving as a separation driving shaft, a paper feeding belt holder bracket 92 (paper feeding belt holder) axially supported by the rotation driving shaft 71 at the proximal end side, a movable side belt support shaft 93 supported by the leading end side of the paper feeding belt holder bracket 92, a driven pulley 94*b* rotatably supported by the pulley 94*a* and the movable side belt support shaft 93 at the driving side fixed to the rotation driving shaft 71, an endless paper feeding belt 95 wrapped around both of the pulleys 94*a*, 94*b*, and a reverse roller 96 (separation roller; see FIG. 1) that comes into contact with the paper feeding belt 95 with a contact angle (so-called nip angle) and a contact pressure in a certain range. More specifically, the separation sheet feeding mechanism 9 includes the paper feeding belt 95 and the reverse roller 96 serving as the separation roller, and when there are not only a sheet of the document 1, which is to be fed, in contact with the paper feeding belt 95 but also a subsequent sheet of document which is in contact with the reverse roller 96, the sheet of the document 1 which is to be fed is fed by the paper feeding belt 95, and the reverse roller 96 separates the subsequent sheet of document from the sheet of the document 1 which is to be fed. Therefore, the rotation driving shaft 71 receives the forward direction rotation from the sheet feeding motor 102 as pick-up driving and separation sheet feeding rotation.

The paper feeding belt holder bracket 92 includes right and left side wall portions 92*a*, 92*b* axially supported by the rotation driving shaft 71 and a connection wall portion 92*c* connecting both of the side wail portions 92*a*, 92*b*, and can swing in the vertical direction with respect to the rotation driving shaft 71. The movable side belt support shaft 93 is supported in such a manner that the both end portions 93*a* (only one end of which is illustrated) can slide to the right and left side wall portions 92*a*, 92*b* of the paper feeding belt holder bracket 92. Between the right and left side wail portions 92*a*, 92*b* of the paper feeding belt holder bracket 92 and the both end portions 93*a* of the movable side belt support shaft 93, a belt tension giving compression coil spring 97 is fixed with a predetermined assembly load so that a predetermined tension is given to the paper feeding belt 95.

The tension (belt tension) acting on the paper feeding belt 95 is in accordance with the load of the belt tension giving compression coil spring 97 and the contact angle of the reverse roller 96 to the paper feeding belt 95, i.e., so-called nip angle at which the paper feeding belt 95 of the predetermined tension wraps around the front surface of the reverse roller 96, and the contact angle of the reverse roller 96 to the paper feeding belt 95 is adjusted by a separation pressure adjustment mechanism 60 (adjustment mechanism) explained later.

The registration unit C includes a separation sensor 33 for detecting a document 1 separated by the separation feeding unit B from the subsequent document bundle on the document table 2, an intermediate portion (having no numeral attached) in the document conveying direction of multiple conveying guides 35, 36, a document abutment sensor 11 for detecting the leading end of the document 1 when the document 1 separated by the paper feeding belt 95 comes in to a proximity of the pull-out roller 12, a pull-out roller 12 for pulling and conveying, in the document conveying direction along the conveying guides 35, 36, the document 1 from the subsequent document bundle when the document 1 of which leading end is detected by the document abutment sensor 11 is pressed against the pull-out roller 12, and multiple document width sensors 13 provided in accordance with the setting number of the sheet size of the document 1 so that the document width sensors 13 are spaced apart from each other in the main scanning direction perpendicular to the document conveying direction. The pull-out roller 12 is driven by reverse rotation of the sheet feeding motor 102.

In this case, the document abutment sensor 11 can read times when the leading end and the trailing end of the document 1 pass the document abutment sensor 11, and the controller counts the motor pulses between the time when the leading end passes and the time when the trailing end passes, thus detecting the length of the document in the conveying direction. The document width sensors 13 are configured such that, for example, the light is selectively shielded in accordance with the sheet size by the document 1 while the multiple document width sensors 13 are arranged in the depth direction of the digital MFP 50, and thus capable of detecting the width direction size perpendicular to the conveying direction of the document conveyed by the pull-out roller 12.

The turn unit D includes a bent portion at the downstream side of the conveying guides 35, 36, an intermediate roller 14 provided in a proximity of the bent portion, conveying guides 37, 41 folding back the document feed path at the downstream side of the conveying guides 35, 36, a scanning entrance roller 16 for conveying the document sheet in the conveying guides 37, 41 to the first scan conveying unit E, and a registration sensor 17 for detecting the leading end of the document sheet at the downstream side of the scanning entrance roller 16, and identifying a time when the leading end thereof reaches the scanning position 20. The intermediate roller 14 includes multiple pairs of rollers for conveying the document conveyed by the pull-out roller 12 into the bent portion at the downstream side of the conveying guides 35, 36, and each of the roller pairs are arranged to be in a proximity of each other so as to be in contact with both surfaces of the document sheet, and the multiple roller pairs are spaced apart from each other in the rotation shaft line direction perpendicular to the document conveying direction. The pull-out roller 12 and the other rollers likewise include multiple pairs of rollers.

The first scan conveying unit E include the slit glass 21 for reading the front face image, the conveying guide 42 provided at the opposite thereto, a scanning roller 19 for conveying the document conveyed to a position close to the slit glass 21 while the document is brought into contact with the slit glass 21, a scanning exit roller 23 for conveying a portion of the document sheet having passed the slit glass 21 to the second scan conveying unit F, and the conveying guide 38 provided at the opposite to the downstream side portion of the conveying guide 42.

The second scan conveying unit F includes a back face scan unit 25 (back face document reading device) including a back face image scanning contact-type image sensor (CIS) arranged between the conveying guide 38, 42 and the conveying guide 39, 43, a scanning roller 26 arranged at the opposite to and in a proximity of the platen glass of the back face scan unit 25 (of which details are not illustrated), and a CIS exit roller 27 rotating substantially in synchronization with the scanning roller 26 so that the sub-scanning direction conveying speed of the document 1 of which back face document is scanned in the main scanning direction by the back face scan unit 25 becomes the same as the document conveying speed with the scanning roller 26. In this case, the scanning roller 26 prevents the back face side of the document 1 from floating from the back face scan unit 25 by pressing the conveyed document 1 to the back face scan unit 25, and also serves as a white reference member for performing shading correction on the back face scan unit 25.

The discharging unit G includes the conveying guide 39, 43, a discharging sensor 24 provided in a proximity of the back face scan unit 25, a discharging roller 28 rotated and driven to discharge the document sheet to the stack unit H after the discharging sensor 24 detects the leading end of the document, and the discharge tray 29 on which the discharged document is placed.

As illustrated in FIG. 2, the document conveying device 52 of the present embodiment includes a controller 100 for controlling operation from the document set unit A to the discharging unit G, and the controller 100 are connected to the document set sensor 5, the home position sensor 6, the feeding appropriate position sensor 8, the document abutment sensor 11, the document width sensor 13, the scanning entrance sensor 15, the registration sensor 17, and the discharging sensor 24 in such a manner that signals can be input.

The document conveying device 52 of the present embodiment includes, as actuators and the like driven and controlled by the output signal from the controller 100, the back face scan unit 25, a pick-up ascending/descending motor 101, the sheet feeding motor 102, the scanning motor 103, the discharging motor 104, and the bottom plate ascending motor 105.

On the other hand, the image forming apparatus main body 51 of the digital MFP 50 having the document conveying device 52 of the present embodiment includes the main body control unit 111 for controlling the image forming apparatus main body 51, and an operating unit 108 with which a user performs various kinds of input operation and gives operation commands. The controller 100 and the main body control unit 111 are connected via the interface circuit 107, so that control signals, data, and the like are exchanged therebetween.

Figure 3:
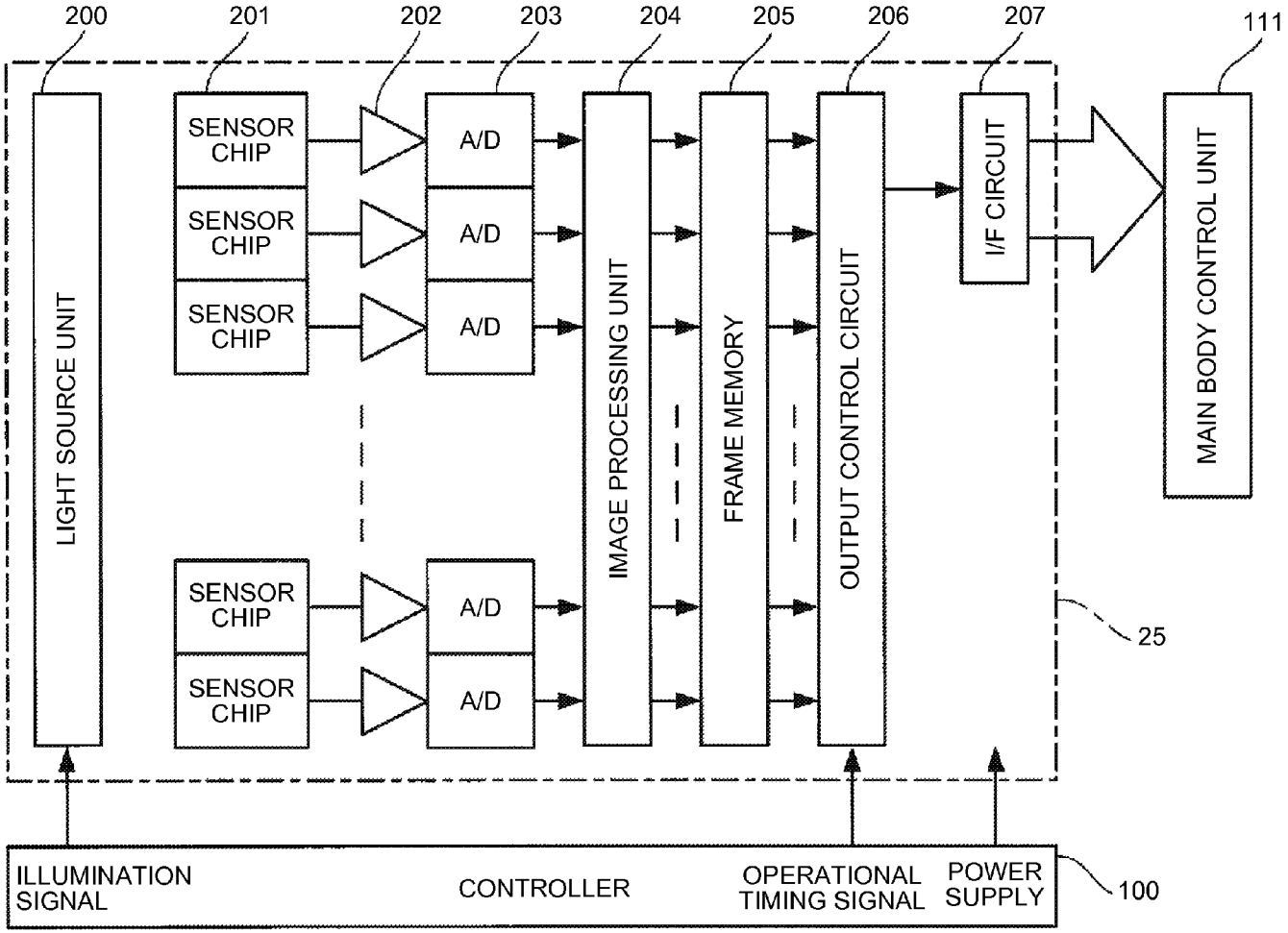
FIG. 3 is a block diagram illustrating a configuration of a back face document reading device of the digital MFP according to an embodiment of the present invention.

As illustrated in FIG. 3, the back face scan unit 25 includes a light source unit 200 for emitting light onto a document based on the light source unit 200 for emitting light onto a document based on an illumination signal from the controller 100, multiple sensor chips 201 receiving reflected light from the document, multiple amplification units 202 for amplifying the signal which is output from each sensor chip 201, an A/D converter 203 converting the amplified signal from an analog signal to a digital signal, and an image processing unit 204 for performing image processing on the signal converted into digital. Further, the back face scan unit 25 includes an output control circuit 206 for performing output control of a digital signal stored in a frame memory 205 based on an operational timing signal given by the controller 100, and an interface circuit 207 for outputting the signal from the output control circuit 206 to the main body control unit 111. It should be noted that electric power is supplied to the back face scan unit 25 from the controller 100.

Hereinafter, basic operation from when the document is placed on the document table 2 to when the document is discharged onto the discharge tray 29 and the control of the controller 100 will be explained in order.

First, the document 1 is placed on the document table 2 including the movable table 3 in such a manner that the front face of the document 1 is at the upper side, and the position of the document 1 in the width direction, i.e., the position in the direction perpendicular to the conveying direction is positioned by a side guide, not illustrated, and thus the document 1 is set.

The set detection feeler 4 and the document set sensor 5 detects that the document 1 is placed on the document table 2, and the detection signal is retrieved into the controller 100, and is also retrieved into the main body control unit 111 via the interface circuit 107. The document size of the document 1 on the document table 2 is detected by the size detection sensors 30 to 32 provided on the front face of the document table 2, and the document size is retrieved into the controller 100, and is also retrieved into the main body control unit 111.

When the document which is set on the document set unit A is thus detected, the controller 100 moves the bottom plate ascending motor 105 in the forward direction, and moves the movable table 3 upward so that the uppermost document sheet of the documents 1 on the document table 2 comes into contact with the pick-up roller 73.

At this occasion, the pick-up roller 73 comes into contact with the upper surface of the document 1 on the document table 2 with a contact pressure in accordance with its own weight from the pick-up bracket 72 to the pick-up roller 73. When the rotation given by the rotation driving shaft 71 is transmitted to the driving side pulley 75*a* via the toothed wheels 74*a*, 74*b*, and is transmitted from the driving side pulley 75*a* via the endless belt 76 to the driven side pulley 75*b*, the pick-up roller 73 rotates together with the driven side pulley 75*b*. Therefore, even when the upper face height of the document 1 on the document table 2 is changed, the contact pressure and the pick-up driving rotation speed of the pick-up roller 73 are maintained at preferable levels.

When the movable table 3 is driven to move upward, the pick-up roller 73 changes its level in the arrow direction in FIG. 1 while it is rotatably supported by the pick-up bracket 72. Then, when the feeding appropriate position sensor 8 detects that the uppermost document of the documents 1 has reached an appropriate feeding position, the pick-up roller 73 is considered to have reached the appropriate feeding position, and the movement in the arrow direction is restricted.

Subsequently, when the operating unit 108 is manipulated to designate any one of duplex mode or single sided mode, and subsequently, a print key is pressed down, a document feeding signal is output from the main body control unit 111 via the interface circuit 107 to the controller 100.

At this occasion, the controller 100 rotates the sheet feeding motor 102 in the forward direction, whereby the pick-up roller 73 is rotated. The pick-up roller 73 having started its rotation picks up the uppermost document on the document table 2.

With the forward rotation of the sheet feeding motor 102, each of the paper feeding belt 95 and the reverse roller 96 is driven in the clockwise direction of FIG. 1, so that while the paper feeding belt 95 is guiding the document 1 in the feeding direction, the reverse roller 96 is operated to push the document in the direction opposite to the feeding direction. Therefore, only the uppermost document 1 of several or less documents 1 picked up by the pick-up roller 73 is separated from the subsequent documents at the lower side thereof, and is fed in the feeding direction.

More specifically, while the reverse roller 96 is in direct contact with the paper feeding belt 95 or is in pressurized contact therewith with a document 1 interposed therebetween within the contact angle, the reverse roller 96 rotates in the counterclockwise direction which is different from the original driving direction due to a torque limiter, not illustrated, in accordance with the rotation of the paper feeding belt 95. However, when not only the uppermost document 1 but also an unnecessary subsequent document at the lower side thereof are picked up in an overlapping manner between the paper feeding belt 95 and the reverse roller 96, then, the reverse roller 96 rotates in the clockwise direction of FIG. 1 while separating the unnecessary subsequent document at the lower side from the uppermost document 1 within the allowable torque range of the torque limiter, thus preventing the document 1 from being fed in an overlapping manner.

The document 1 separated by the action of the paper feeding belt 95 and the reverse roller 96 as described above (which may be hereinafter also referred to as separated document 1) is fed in the feeding direction by the paper feeding belt 95, and after the leading end thereof is detected by the document abutment sensor 11, the document 1 comes into abutment with the pull-out roller 12.

This abutment is such that while the separated document 1 is conveyed in the feeding direction by a predetermined distance from the position where it is detected by the document abutment sensor 11, the leading end side portion of the separated document 1 comes into abutment with the pull-out roller 12 with a predetermined amount of warping. Then, at this point in time, the sheet feeding motor 102 is stopped, and driving of the paper feeding belt 95 is stopped.

While the separated document 1 is conveyed by the paper feeding belt 95, the controller 100 raises the pick-up roller 73 from the upper face of the document 1 so as to be away therefrom using the pick-up ascending/descending motor 101 by means of the cam mechanism and pick-up bracket 72, not illustrated, and conveys the document using only the conveying force of the paper feeding belt 95. As a result, when the leading end of the document comes into abutment with the nip portion of the pull-out roller 12, the skew of the document is corrected.

Subsequently, the pull-out roller 12 and the intermediate roller 14 are driven in the backward direction by the sheet feeding motor 102, so that the skew-corrected document is conveyed to the intermediate roller 14. At this occasion, the pull-out roller 12 and the intermediate roller 14 are driven, but the pick-up roller 73 and the paper feeding belt 95, which are driven when the sheet feeding motor 102 moves in the forward direction, are in the non-driven state.

During the document conveying process to the intermediate roller 14, when the document passes the position where the multiple document width sensors 13 are installed, the controller 100 detects a difference of output levels between those shielded by the document 1 and those not shielded by the document 1 from among the multiple document width sensors 13 adjacent to each other in the document width direction, and the width direction size of the document conveyed by the pull-out roller 12 is detected, and the document size thereof is notified to the main body control unit 111.

The conveying state and the conveying direction length of the document 1 conveyed are detected by causing the document abutment sensor 11 to scan the leading end and the trailing end of the document 1 and counting the driving pulses of the conveying motor.

When the document is conveyed from the registration unit C to the turn unit D according to the driving of the pull-out roller 12 and the intermediate roller 14, the controller 100 configures the conveying speed such that the conveying speed at the registration unit C is set at a level higher than the conveying speed at the first scan conveying unit E, thus reducing the processing time required to feed the document into the first scan conveying unit E.

Operation from when the leading end of the conveyed document 1 is detected by the scanning entrance sensor 15 to when the scanning process starts is different according to whether the mode is non-stop mode or stop mode.

First, in the non-stop mode, the controller 100 starts reducing the document conveying speed in order to set the document conveying speed at the same level as the scanning conveying speed before the leading end of the document 1 enters into the nip portion of the scanning entrance roller 16, and thereafter uses the scanning entrance motor 114 to drive the scanning entrance roller 16, and further, uses the scanning motor 103 to drive each of the scanning roller 19, the scanning exit roller 23, and the CIS exit roller 27.

Subsequently, when the leading end of the document 1 is detected by the registration sensor 17, a gate signal indicating an effective image region in the sub-scanning direction of the front face is started to be transmitted from the controller 100 to the main body control unit 111 at a time when the leading end position of the document 1 detected by pulse-counting of the scanning motor 103 reaches the scanning position 20, and the gate signal is continuously transmitted until the trailing end position of the document 1 passes the scanning position 20

On the other hand, in the stop mode, after the leading end of the conveyed document 1 is detected by the scanning entrance sensor 15, the controller 100 stops the document 1 (registration stop) at a time when the document 1 comes into abutment into the nip portion of the scanning entrance roller 16 and a predetermined amount of warping occurs in the leading end portion of the document 1 (a time when a predetermined number of counted pulses is attained after the leading end is detected by the scanning entrance sensor 15), a registration stop signal is transmitted to the main body control unit 111 via the interface circuit 107. In this case, the position where the scanning entrance roller 16 is provided is a position where the document 1 once stops before the document 1 is begun to be scanned.

Subsequently, when the controller 100 receives a scanning start signal from the main body control unit 111, the controller 100 starts conveying the document 1 which is registered and stopped, and increases the conveying speed to attain a predetermined conveying speed so that the leading end position of the document 1 reaches the scanning position 20.

In this case, the time when the leading end of the conveyed document 1 reaches the scanning position 20 can be detected by counting the driving pulses of the scanning motor 103 from when the leading end of the conveyed document 1 is detected by the registration sensor 17.

Then, from when the leading end of the conveyed document 1 reaches the scanning position 20 to when the trailing end of the document 1 passes the scanning position 20, the gate signal indicating the effective image region of the front face in the sub-scanning direction is transmitted from the controller 100 to the main body control unit 111.

When the operation mode is a single sided mode, the controller 100 uses the scanning roller 19 and the scanning exit roller 23 to pass the document, which has passed the first scan conveying unit E, in a proximity of the back face scan unit 25 and the document reaches the CIS exit roller 27, and the document is conveyed to the discharging unit G. At this occasion, when the discharging sensor 24 detects the leading end of the document 1, the controller 100 rotates the discharging motor 104 in the forward direction to rotate the discharging roller 28 in the discharging direction (counterclockwise direction in FIG. 1). The controller 100 counts the pulses of the discharging motor 104 since the discharging sensor 24 detects the leading end of the document 1, and decreases the driving speed of the discharging motor 104 immediately before the trailing end of the document 1 goes out of the nip region of the discharging roller 28, and controls the discharging speed so that the document 1 discharged onto the discharge tray 29 does not get out of the discharge tray 29.

As described above, in the stop mode, when the scanning entrance sensor 15 detects the leading end of the document 1, the document 1 once stops at the scanning entrance roller 16, and in the non-stop mode, the document 1 is conveyed without being stopped temporarily.

When the operation mode is the duplex mode, the controller 100 counts the pulses of the scanning motor 103 since the leading end of the document 1 is detected by the discharging sensor 24, and outputs the gate signal indicating the effective image region in the sub-scanning direction to the back face scan unit 25 when the leading end of the document 1 reaches the scanning position of the back face scan unit 25. This gate signal is continuously output until the trailing end of the document 1 goes out of the document scanning position of the back face scan unit 25. When the trailing end of the document 1 goes out of the document scanning position of the back face scan unit 25, the controller 100 controls the driving speed of the discharging motor 104 so that the document 1 discharged onto the discharge tray 29 does not get out of the discharge tray 29.

Although the detailed hardware configuration of the controller 100 executing the control of document conveying operation as described above is not illustrated, the controller 100 includes a CPU, a ROM, a RAM, and an input/output interface circuit. In accordance with the control program stored in the ROM, when the feeding preparation operation is to be done, the controller 100 rotates the bottom plate ascending motor 105 in the forward direction, and raises the movable table 3 which is the bottom plate so that the uppermost surface of the document 1 on the document table 2 comes into contact with the pick-up roller 73, and when the feeding appropriate position sensor 8 attains the ON state, the controller 100 stops the upward movement of the movable table 3. Then, with the repetition of the feeding operation, the document upper face position is lowered, and when the feeding appropriate position sensor 8 is in the OFF state, the movable table 3 is raised so that the feeding appropriate position sensor 8 is in the ON state again. The controller 100 repeats this kind of bottom plate ascending control, thus maintaining the uppermost face position of the document 1 at a level appropriate for feeding at all times.

On the other hand, when the set documents on the document table 2 are all fed, and there is no longer any document 1 left on the document table 2, the controller 100 rotates the bottom plate ascending motor 105 in the backward direction as a sheet stacking preparation operation, and lowers the movable table 3 to the home position so that a subsequent document bundle can be set.

The controller 100 uses the pick-up ascending/descending motor 101 with the cam mechanism and the pick-up bracket 72 to raise the pick-up roller 73 to a different height position, and changes the level in c, d directions indicated by the arrow in FIG. 1. When the movable table 3 is raised, the pick-up roller 73 is also raised by the document upper face on the movable table 3.

Further, when the document 1 is conveyed from the registration unit C to the turn unit D according to the driving of the pull-out roller 12 and the intermediate roller 14, the controller 100 configures the conveying speed such that the conveying speed at the registration unit C is set at a level higher than the conveying speed at the first scan conveying unit E, thus reducing the time required to convey the document 1 to the scanning unit.

FIG. 3 is a block diagram illustrating a relevant portion of an electric circuit of the back face scan unit 25. As illustrated in the figure, the back face scan unit 25 includes the light source unit 200 constituted by an LED array, a fluorescent light, or a cold cathode tube. The back face scan unit 25 includes multiple sensor chips 201 arranged in the main scanning direction (direction corresponding to the document width direction), multiple operational amplifier circuits 202 individually connected to the sensor chip 201, respectively, and multiple A/D converters 203 individually connected to the operational amplifier circuits 202, respectively. Further, the back face scan unit 25 also includes the image processing unit 204, the frame memory 205, the output control circuit 206, and the interface circuit 207.

The sensor chip 201 is provided with a contact-type image sensor constituted by an photoelectric conversion element and a condensing lens and the like. Before a document, not illustrated, enters into the scanning position with the back face scan unit 25, the controller 100 transmits an illumination ON signal to the light source unit 200. Accordingly, the light source unit 200 is turned on, and the light is emitted onto the second face of the document, not illustrated. With the multiple sensor chips 201, the reflected light reflected by the second face of the document is condensed by the condensing lens onto the photoelectric conversion element, and is scanned as image information. The image information scanned by each sensor chip 201 is amplified by the operational amplifier circuit 202, and thereafter converted into digital image information by the A/D converter 203. The digital image information is input into the image processing unit 204 to be subjected to the shading correction and the like, and thereafter it is stored to the frame memory 205 temporarily. Thereafter, it is converted by the output control circuit 206 into a data format that can be received by the main body control unit 111, and thereafter, it is output via the interface circuit 107 to the main body control unit 111. The controller 100 output an operational timing signal for notifying a time when the leading end of the document reaches the scanning position with the back face scan unit 25 (image data after this point in time will be treated as effective data), an illumination signal for the light source, a power supply, and the like.

Subsequently, detailed configuration of the separation sheet feeding mechanism related to the features of the present invention will be explained.

Figure 4:
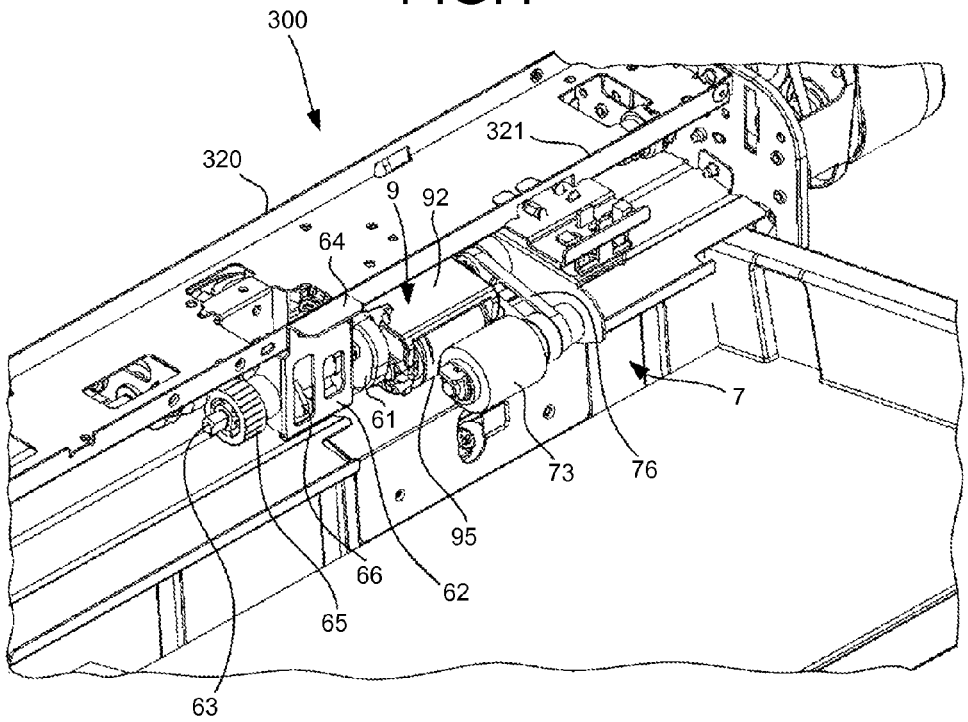
FIG. 4 is a relevant portion external appearance perspective view illustrating a sheet feeding unit of the digital MFP according to an embodiment of the present invention.
Figure 5:
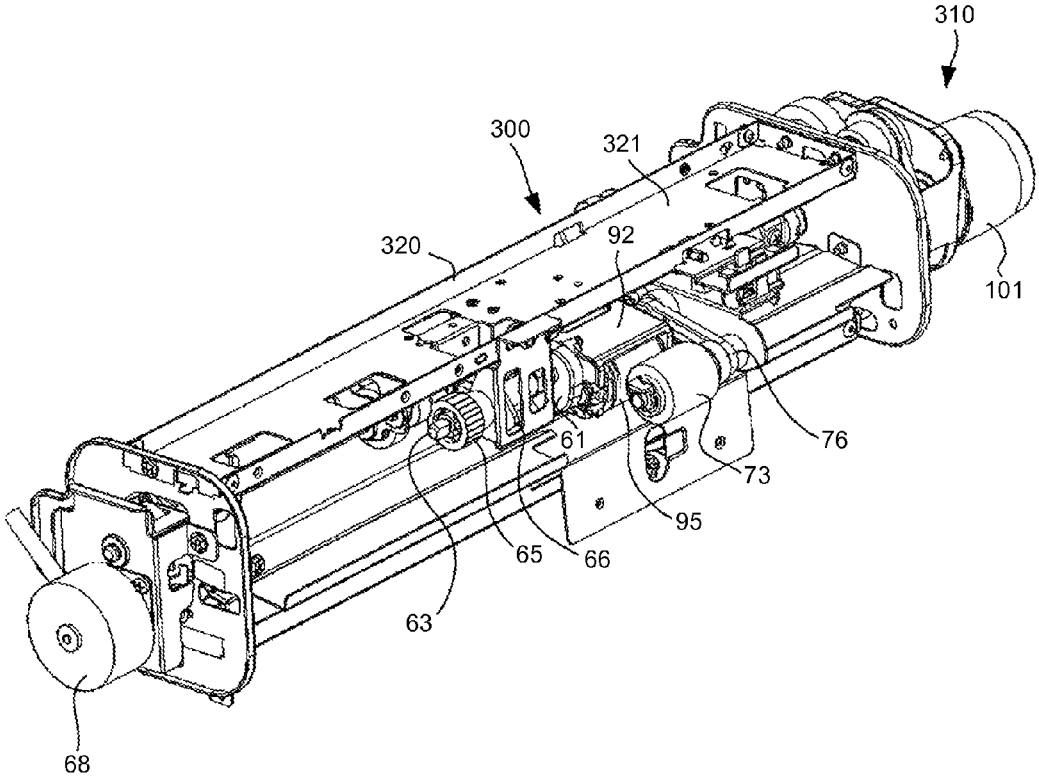
FIG. 5 is an external appearance perspective view of the entire sheet feeding unit of the digital MFP according to an embodiment of the present invention.

As illustrated in FIGS. 4 and 5, the separation feeding unit B is configured such that its main portion can be detached as the sheet feeding unit 300 from the main frame of the document conveying device 52.

As illustrated in FIGS. 4 to 9, the sheet feeding unit 300 is provided with components and the like required for separation sheet feeding such as a paper feeding belt 95, a reverse roller 96, and a pick-up roller 73, and a feeding driving unit 310 including a sheet feeding motor 102, and these components as a whole are supported by the frame 320 that can be detachably attached to the main frame of the document conveying device 52.

Figure 6:
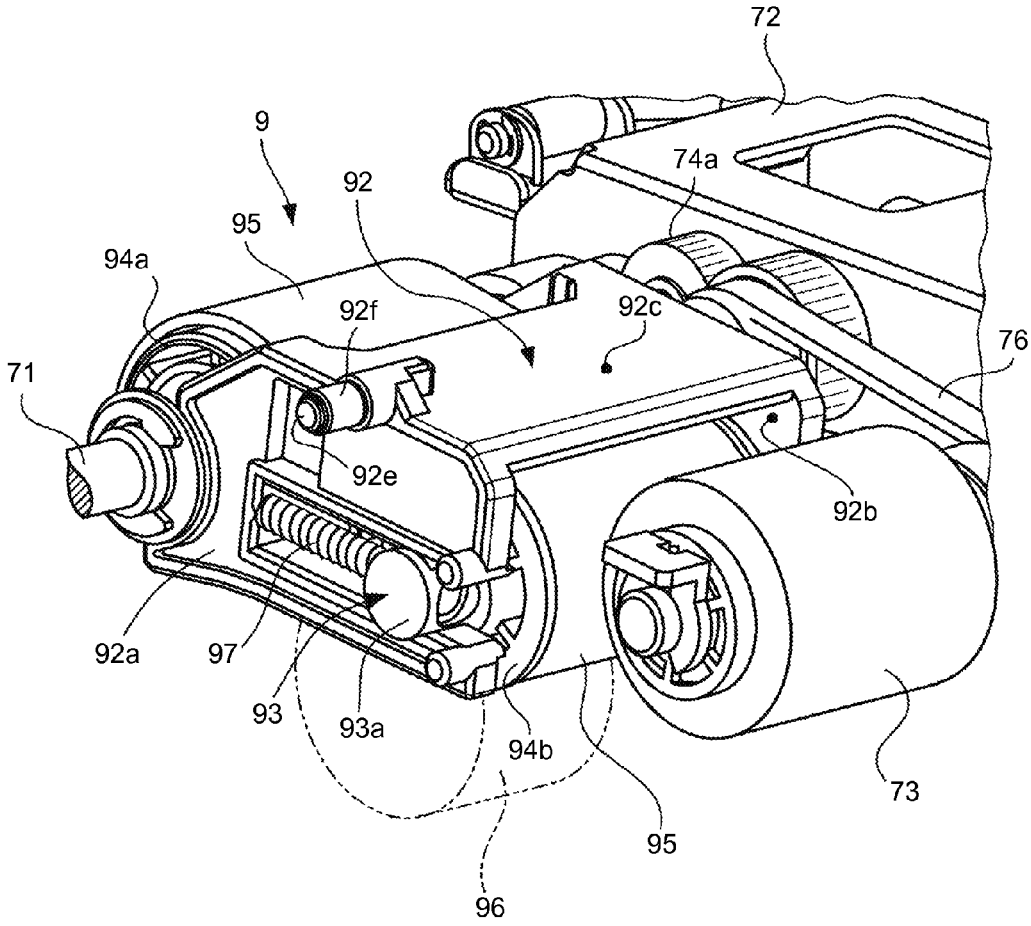
FIG. 6 is an enlarged perspective view illustrating a separation sheet feeding mechanism of the digital MFP according to an embodiment of the present invention.
Figure 7:
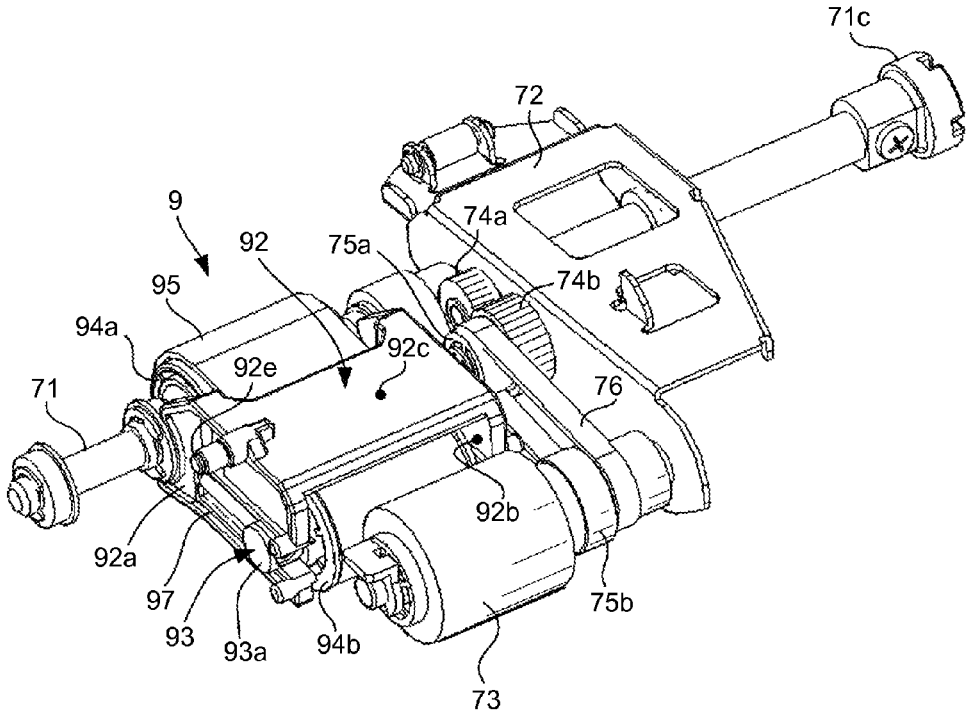
FIG. 7 is an enlarged perspective view illustrating a separation sheet feeding mechanism and a pick-up mechanism of the digital MFP according to an embodiment of the present invention.

As illustrated in FIGS. 5 to 7, the pick-up mechanism 7 and the separation sheet feeding mechanism 9 of the separation feeding unit B are units combined in such a manner that they can rotate relative to each other via the rotation driving shaft 71, and in this state, the pick-up roller 73 is maintained in parallel at the upstream side in the conveying direction of the paper feeding belt 95. The pick-up mechanism 7 is provided at a side in the width direction of the paper feeding belt 95 which is the axial direction of the rotation driving shaft 71 with respect to the paper feeding belt 95 of the separation sheet feeding mechanism 9 (the right side of FIG. 7; hereinafter this may be referred to the other side in the width direction).

Figure 10:
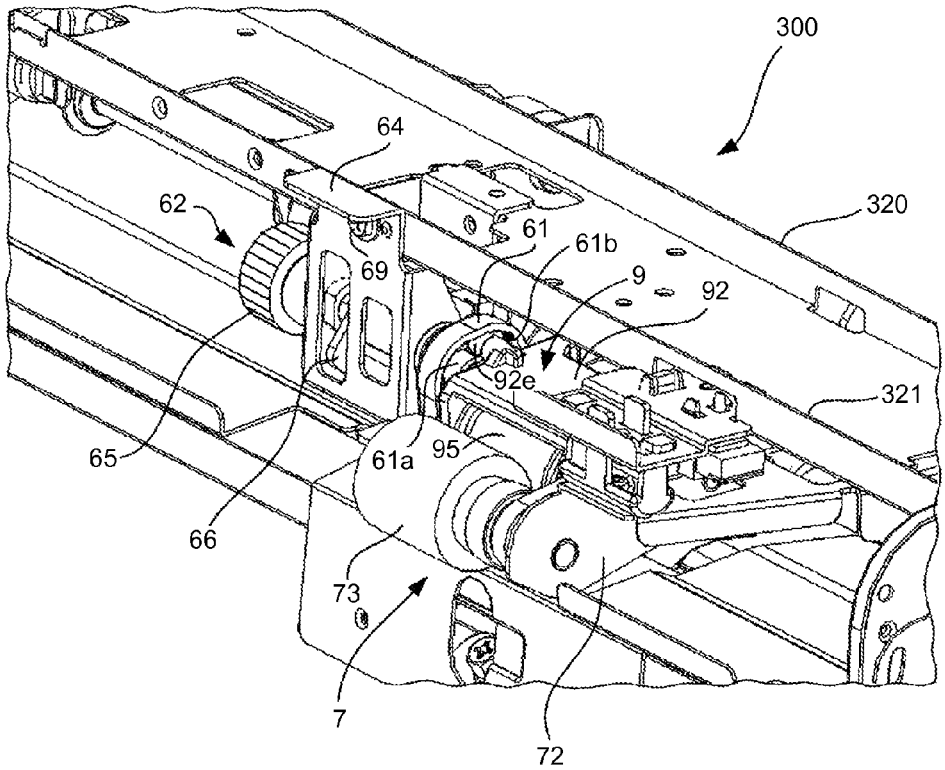
FIG. 10 is an enlarged perspective view in a proximity of the separation pressure adjustment mechanism of the digital MFP according to an embodiment of the present invention.
Figure 11:
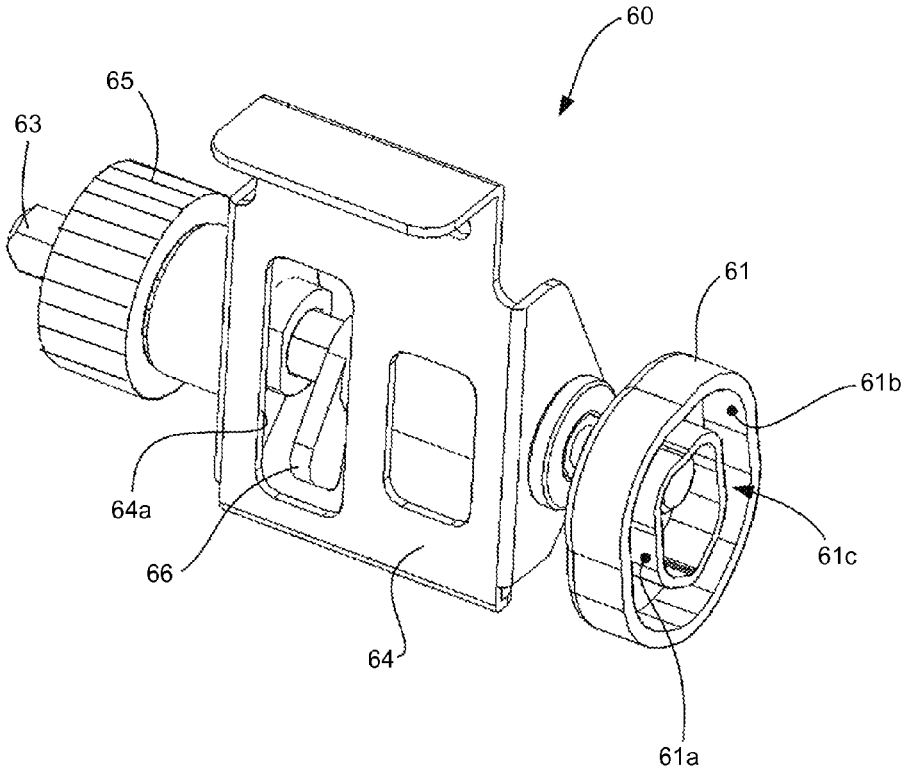
FIG. 11 is an external appearance perspective view illustrating a cam driving unit of the separation pressure adjustment mechanism of the digital MFP according to an embodiment of the present invention.

As illustrated in FIGS. 5, 10, and 11, at another side in the width direction of the paper feeding belt 95 (the left side of FIG. 7; hereinafter this may be referred to one side in the width direction), a separation pressure adjustment mechanism 60 is provided to adjust the contact angle of the nip portion of the paper feeding belt 95 with respect to the reverse roller 96, and capable of switching separation performance, and in particular, switching the separation pressure (hereinafter simply referred to as separation pressure) at multiple levels.

This separation pressure adjustment mechanism 60 includes a cam member 61 including a first cam face 61*a* and a second cam face 61*b* facing each other in the rotation radius direction, a cam driving unit 62 (cam driving source) capable of rotating the cam member 61 and maintaining it at the rotation angle position, and a paper feeding belt holder bracket 92 serving as a cam follower member for changing the relative position of the paper feeding belt 95 and the reverse roller 96 in accordance with the rotation angle position of the cam member 61.

More specifically, as illustrated in FIGS. 6 and 10, the paper feeding belt holder bracket 92 of the separation sheet feeding mechanism 9 includes a substantially pillar shaped protruding pin 92*e* (contact unit, protruding unit) protruding in the axial direction parallel to the rotation driving shaft 71 from the side wall portion 92*a* of the other side in the width direction of the paper feeding belt 95, and the leading end side of the protruding pin 92*e* is inserted into the circular cam groove portion 61*c* in which the first cam face 61*a* and the second cam face 61*b* are sidewall surfaces of both sides in the rotation radius direction, so that the protruding pin 92*e* is positioned between the first cam face 61*a* and the second cam face 61*b* in the rotation radius direction of the cam member 61.

As illustrated in FIGS. 8 and 11, the first cam face 61*a* and the second cam face 61*b* of the cam member 61 are spaced apart substantially with a regular interval in the rotation radius direction at multiple rotation angle position of any given number, and the leading end side of the protruding pin 92*e* of the paper feeding belt holder bracket 92 is inserted between the first cam face 61*a* and the second cam face 61*b*. The protruding pin 92*e* is guided along the first cam face 61*a* and the second cam face 61*b* to relatively move (slide or rotate) in the rotation direction (circumferential direction) of the cam member 61, and positioned at a lift position corresponding to lifts L1, L2 or L3 according to the rotation angle position from the both sides in the rotation radius direction of the cam member 61.

More specifically, the first cam face 61*a* and the second cam face 61*b* respectively are formed in parallel with the rotation central axis of the cam member 61, and are parallel to each other. The rotation radius of the first cam face 61*a* according to the rotation angle position of the cam member 61 is less than the rotation radius of the second cam face 61*b* according to the rotation angle position of the cam member 61.

Further, when the protruding pin 92*e* of the paper feeding belt holder bracket 92 moves along the first cam face 61*a*, the second cam face 61*b* of the cam member 61 is formed along a virtual envelope always in contact with the protruding pin 92*e* of the paper feeding belt holder bracket 92 from the opposite side to the first cam face 61*a* in the rotation radius direction of the cam member 61. When the protruding pin 92*e* of the paper feeding belt holder bracket 92 of which leading end side is in a circular cross section moves relatively along the first cam face 61*a* according to the rotation of the cam member 61, the second cam face 61*b* is restricted within a guide clearance range which previously sets floating of the protruding pin 92*e* of the paper feeding belt holder bracket 92 from the first cam face 61*a* (floating of the cam member 61 in the rotation radius direction).

More specifically, when the cam member 61 rotates, the first cam face 61*a* and the second cam face 61*b* of the cam member 61 restricts the displacement of the protruding pin 92*e* in the rotation radius direction of the cam member 61 within the guide clearance range, and at the same time allows positioning at the lift position corresponding to such cam profile and rotation angle position.

Figure 9:
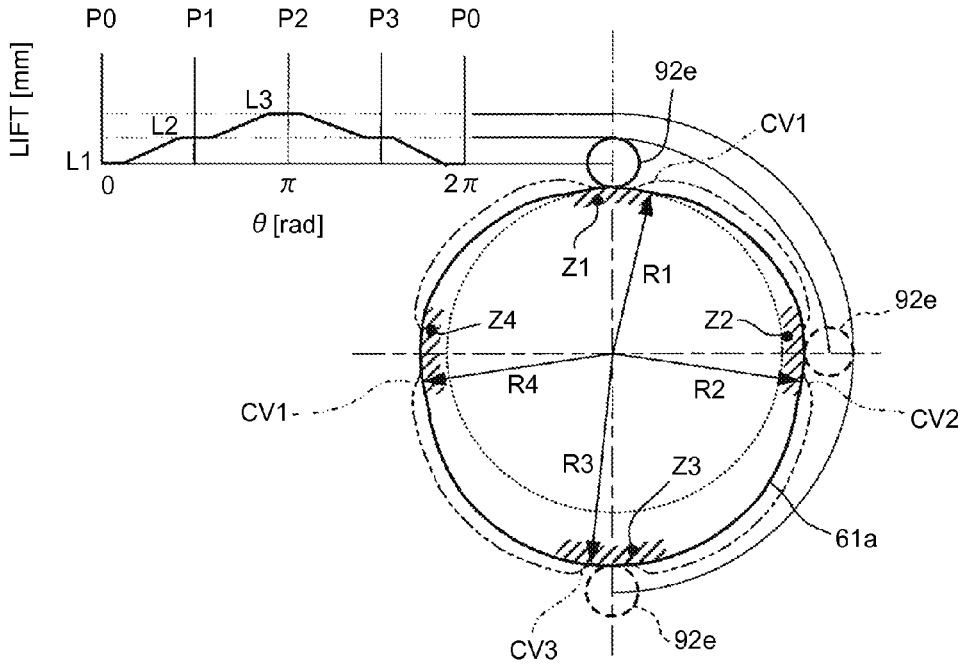
FIG. 9 is an explanatory diagram illustrating a cam profile of a first cam face of a cam member of the separation pressure adjustment mechanism of the digital MFP according to an embodiment of the present invention.

As illustrated in FIG. 9, the first cam face 61*a* of the cam member 61 has a cam profile of which lift corresponding to raised height (displacement) of the protruding pin 92*e* is changed in multiple steps (in the figure, three steps) in accordance with the rotation angle position. For example, the first cam face 61*a* of the cam member 61 is formed to have a cam face portion in an arc shape (which means that the contour of the cam face is in the arc shape), so as to maintain the lifts L1, L2, L3 at a certain level, within angle ranges of four separation pressure maintaining sections Z1 to Z4 of the first cam face 61*a* separating with 90 degrees central interval (for example, within a range of 30 degrees corresponding to 15 degrees rotation in the forward and the backward directions).

More specifically, as illustrated in FIG. 9, the first cam face 61*a* includes radiuses R1, R2, R3, R2 corresponding to the lifts L1, L2, L3, L2, respectively, in the four separation pressure maintaining section Z1 to Z4. When the rotation angle θ [rad] of the cam member 61 rotates in the clockwise direction in the figure from an angle position P0 to an angle position P1 which is a position changed 90 degrees (in the figure, π/2 [rad])) in the clockwise direction in the figure, the lift of the first cam face 61*a* increases from the minimum lift value L1 to the intermediate lift value L2 (>L1), and when the rotation angle θ of the cam member 61 further changes from the angle position P1 to the angle position P2 which is a position changed 90 degrees in the clockwise direction in the figure, the lift of the first cam face 61*a* increases from the intermediate lift value L2 to the maximum lift value L3. When the rotation angle θ of the cam member 61 further rotates from the angle position P2 to an angle position P3 changed 90 degrees in the clockwise direction in the figure, the lift of the first cam face 61*a* decreases from the maximum lift value L3 to the intermediate lift value L2, and when the rotation angle θ of the cam member 61 further changes from the angle position P3 changed 90 degrees in the clockwise direction in the figure to return back to the angle position P0, the lift of the first cam face 61*a* decreases from the intermediate lift value L2 to the minimum lift value L1.

As illustrated by a virtual line (chain double-dashed line) in FIG. 9, between the adjacent sections of the four separation pressure maintaining sections Z1 to Z4, the first cam face 61*a* of the cam member 61 may have a radius larger than a radius corresponding to the lifts L, L2 (lifts L2, L3, or, L3, L 0) of the separation pressure maintaining sections Z1, Z2 adjacent to each other (separation pressure maintaining sections Z2, Z3, or, separation pressure maintaining sections Z3, Z0), for example. More specifically, the first cam face 61*a* of the cam member 61 may have concaved cam face portions CV1, CV2, CV3, CV4 that comes into contact with the protruding pin 92*e* of the paper feeding belt holder bracket 92 from both sides in the cam rotation direction within a particular angle range corresponding to the four separation pressure maintaining sections Z1 to Z4, and capable of suppressing change of the rotation angle position of the cam member with respect to the protruding pin 92*e* of the paper feeding belt holder bracket 92.

In the present embodiment, the lift of the first cam face 61*a* of the cam member 61 changes on every 90-degree rotation, and the contact angle of the nip portion of the paper feeding belt 95 with respect to the separation pressure and the reverse roller 96 can be switched to three levels, but it is to be understood that a different number of steps for switching and a different lift interval may be set.

As illustrated in FIGS. 4 to 10, the cam driving unit 62 is configured as a unit including a cam driving shaft 63 provided in parallel with the rotation driving shaft 71 so as to support the cam member 61 at one end side, a support bracket 64 supported by the frame 320 of the sheet feeding unit 300 and rotatably supporting the cam driving shaft 63, a motion transmission toothed wheel 65 attached to the other end side of the cam driving shaft 63, an inclination feeler 66 fixed to the cam driving shaft 63 so as to rotate together with the cam driving shaft 63, a cam angle position sensor 67 (see FIG. 2) for detecting change of the rotation angle position of the inclination feeler 66, for example, detecting that the inclination feeler 66 has returned back to the rotation angle position P0 which is the home position, and a cam driving motor 68 supported by the frame 320 of the sheet feeding unit 300.

In this case, the inclination feeler 66 can be seen from the outside of the sheet feeding unit 300 through an opening portion 64*a* of the support bracket 64, and changes the inclination posture in accordance with the change of the rotation angle of the cam driving unit 62, and enters into or retracts from the opening portion 64*a* of the support bracket 64 in accordance with the rotation angle position of the cam driving shaft 63. The cam angle position sensor 67 is constituted by a switch changing the ON/OFF state in accordance with the inclination feeler 66 returned back to the home position, and is provided within the sheet feeding unit 300. The cam driving motor 68 is supported by one end side of the frame 30 of the sheet feeding unit 300 in the longitudinal direction, and can transmit rotation motion to the motion transmission toothed wheel 65 via a motion transmission path, not illustrated. It should be noted that the sheet feeding motor 102 is supported by the other end side of the frame 320 of the sheet feeding unit 300 in the longitudinal direction, which is opposite to the cam driving motor 68.

The support bracket 64 is fixed with a fixing screw 69 to the frame 320 of the sheet feeding unit 300, but when the fixing screw 69 is removed, the support bracket 64 can be moved in the axial direction of the cam driving shaft 63 with respect to the frame 320, or, it can be detached from the frame 320.

Figure 12A:
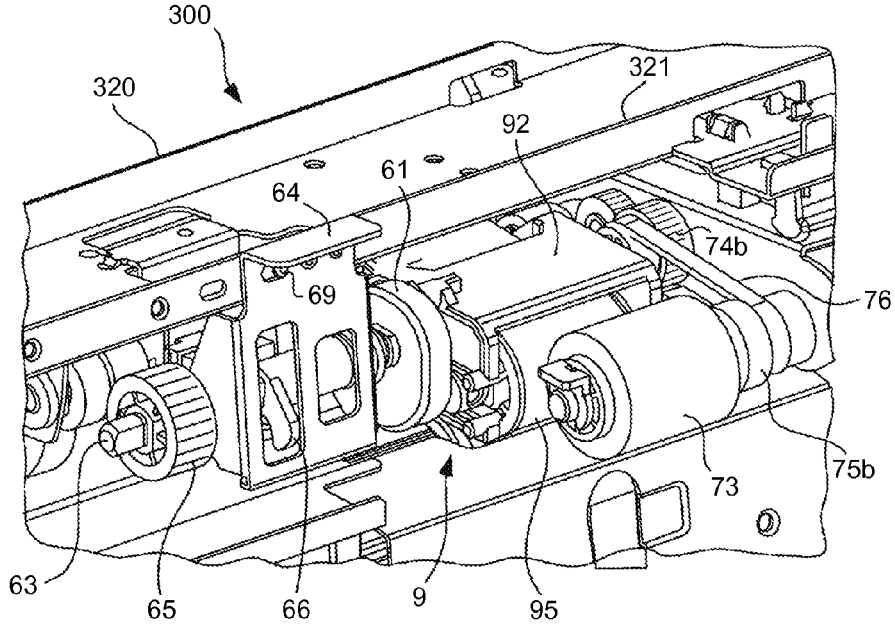
Figure 12B:
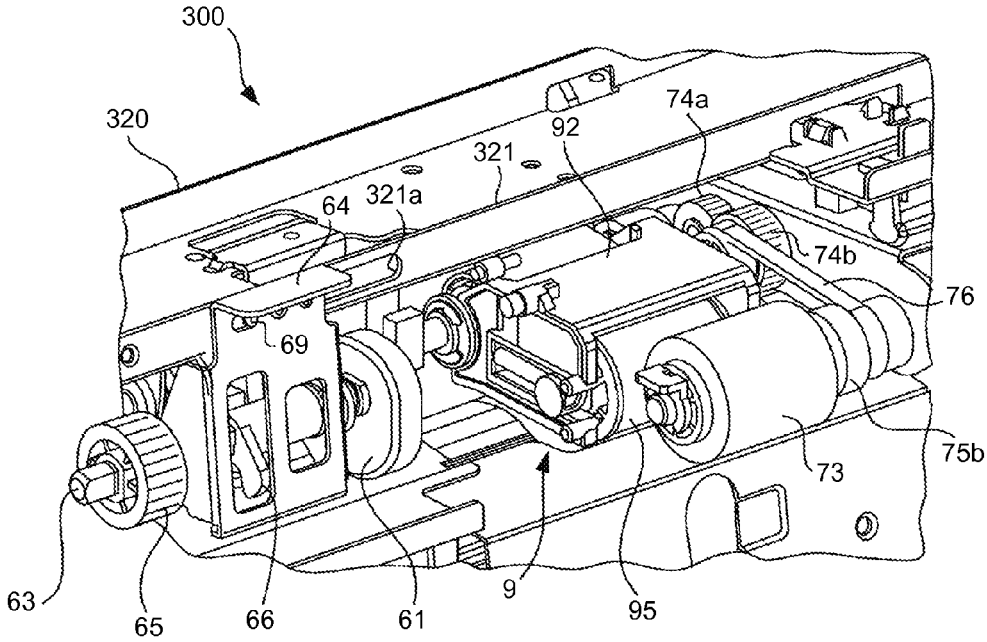

More specifically, as illustrated in FIG. 12B, on any one of the bracket 64 and the frame 320, e.g., on a stay portion 321 of the frame 320, a slide guide groove 321*a* (which may be an oval hole or substantially U-shaped notch) is formed to allow the support bracket 64 to slide along the stay portion 321 of the frame 320 when the fixing screw 69 is loosened. Therefore, by moving the support bracket 64 in the axial direction of the cam driving shaft 63 with respect to the frame 320, the cam driving unit 62 can be moved away from the paper feeding belt holder bracket 92 of the separation sheet feeding mechanism 9, and the protruding pin 92*e* of the paper feeding belt holder bracket 92 can be moved away from within the circular cam groove portion 61*c* of the cam member 61.

When the cam driving unit 62 is moved away from the paper feeding belt holder bracket 92 of the separation sheet feeding mechanism 9, the pick-up mechanism 7 and the separation sheet feeding mechanism 9 integrally coupled with the rotation driving shaft 71 can be detached from the frame 320 of the sheet feeding unit 300 as follows. By cancelling the connection state between a coupling 71*c* at the right end portion in FIG. 7 of the rotation driving shaft 71 and a coupling at the feeding driving unit 310 of the sheet feeding unit 300 (Oldham coupling and the like, not illustrated, integrally coupling in the rotation direction), the pick-up mechanism 7 and the separation sheet feeding mechanism 9 integrally coupled with the rotation driving shaft 71 can be detached from the frame 320 of the sheet feeding unit 300.

In the sheet feeding unit 300, as described above, when the support bracket 64 is moved with respect to the frame 320 so as to move the cam driving unit 62 away from the paper feeding belt holder bracket 92, the restriction state can be cancelled. In the restriction state, the protruding pin 92*e* of the paper feeding belt holder bracket 92 is positioned at the lift position in accordance with the rotation angle position from both sides in the rotation radius direction of the cam member 61 with the first cam face 61*a* and the second cam face 61*b*.

Figure 8A:
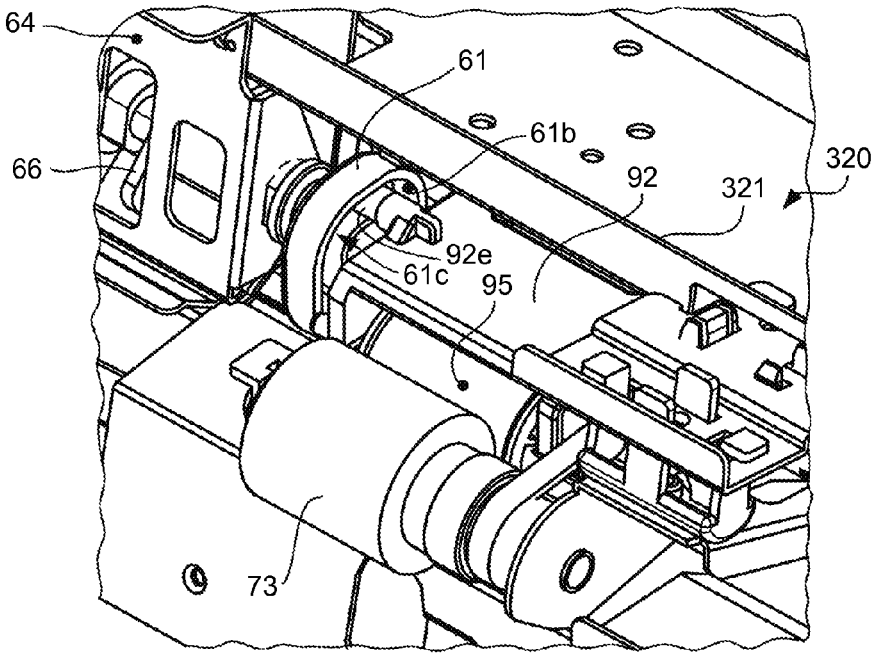
FIG. 8A is a partially enlarged perspective view illustrating connection state of a paper feeding belt holder bracket of a separation pressure adjustment mechanism and a cam member driving it in a separation pressure adjustment direction in the digital MFP according to an embodiment of the present invention.
Figure 8B:
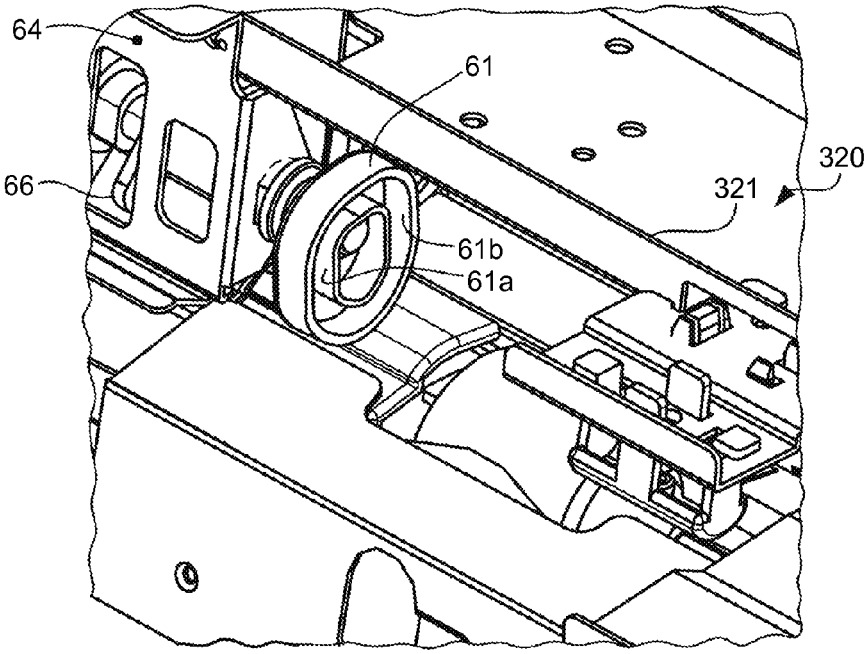
FIG. 8B is a partially enlarged perspective view illustrating a state where the separation sheet feeding mechanism and the driving mechanism at the cam member side are separated.

The cam member 61 can move in the rotation center axial direction of the cam member 61 with respect to the protruding pin 92*e* of the paper feeding belt holder bracket 92, and can move between a contact position as illustrated in FIG. 8A where the cam member 61 is in contact with the protruding pin 92*e* of the paper feeding belt holder bracket 92 and a separation position as illustrated in FIG. 8B where the cam member 61 is away from the protruding pin 92*e* of the paper feeding belt holder bracket 92.

A cylindrical roller 92*f* is attached to the protruding pin 92*e* of the paper feeding belt holder bracket 92 so as to reduce the frictional force during sliding with the separation pressure adjustment mechanism 60. This cylindrical roller 92*f* is configured to freely rotate regardless of the rotation of the cam member 61 for separation pressure adjustment, and the sliding resistance can be reduced during rotation of the cam member 61. In the present embodiment, the cylindrical roller 92*f* is provided, but when a material having a superior sliding property is selected for the protruding pin 92*e*, the protruding pin 92*e* may be a simple round stick-shaped pin.

Subsequently, an operation will be explained.

In the digital MFP 50 of the present embodiment as configured above, when the cam member 61 rotates, the protruding pin 92*e* sandwiched between the first cam face 61*a* and the second cam face 61*b* is restricted from freely moving in the rotation radius direction by the two cam faces 61*a*, 61*b*, and when the cam member 61 rotates in that state, the contact angle of the nip portion of the paper feeding belt 95 with respect to the reverse roller 96 is gradually changed.

More specifically, as illustrated in FIGS. 8A and 85, the rotation centers of the first cam face 61*a* and the second cam face 61*b* are on the rotation center axis of the cam driving shaft 63, and the first cam face 61*a* and the second cam face 61*b* are maintained with a regular interval from each other at multiple rotation angle positions, and therefore, as described above, when the cam member 61 rotates, the first cam face 61*a* and the second cam face 61*b* guide the protruding pin 92*e* from both sides in the rotation radius direction of the cam member 61, and positions it at the lift position in accordance with the rotation angle position thereof.

In order to find the rotation angle position of the cam member 61, the inclination feeler 66 is attached to the cam driving shaft 63, and the inclination feeler 66 and the cam angle position sensor 67 are provided within the sheet feeding unit 300, and therefore, the position at the start of rotation of the cam member 61 can be detected, and it can be returned back to the home position. Therefore, when a stepping motor and the like is used for the cam driving motor 68, the initial position of the cam member 61 and the rotation angle therefrom can be controlled using the driving pulse of the stepping motor, and the cam member 61 can be controlled to be at an appropriate lift position. As a result, the cam member 61 can be stopped at an appropriate rotation angle position, and the contact angle of the nip portion of the paper feeding belt 95 with respect to the reverse roller 96 can be appropriately adjusted.

Further, the cam member 61 can move in the rotation center axial direction of the cam member 61 with respect to the protruding pin 92*e* of the paper feeding belt holder bracket 92, and can move between a contact position where the cam member 61 is in contact with the protruding pin 92*e* of the paper feeding belt holder bracket 92 and a separation position where the cam member 61 is away from the protruding pin 92*e* of the paper feeding belt holder bracket 92, and therefore, it is easy to separate and reconnect the cam member 61 and the paper feeding belt holder bracket 92, and this makes it easy to maintain the separation sheet feeding mechanism 9 including the paper feeding belt 95 and the separation pressure adjustment mechanism 60, and further, to maintain the pick-up mechanism 7

As illustrated in FIG. 5, the cam driving unit 62 driving the cam member 61 is provided at the opposite side to the pick-up mechanism 7 and the sheet feeding motor 10 driving it with respect to the paper feeding belt holder bracket 92 of the separation sheet feeding mechanism 9 and paper feeding belt 95, and therefore, the size of the sheet feeding unit 300 can be reduced. In addition, the cam driving unit 62 of the separation pressure adjustment mechanism 60 provided at one side of the paper feeding belt 95 can be easily separated from the feeding driving unit 310 which is the separation sheet feeding driving source, and this makes it easy to arrange and ensure the maintenance work space for the separation pressure adjustment mechanism 60.

Even if the thickness of a sheet which is to be passed is not appropriate or the driving load of the sheet feeding motor 102 is not appropriate for the contact angle of the nip portion and the separation pressure of the paper feeding belt 95 and the reverse roller 96 which are set in advance, abrupt change of the contact angle of the nip portion of the paper feeding belt 95 and the reverse roller 96 can be effectively prevented during the document conveying process. The cam member 61 is configured such that the lift position of the protruding pin 92*e* of the paper feeding belt holder bracket 92 can be switched in multiple steps, and the appropriate rotation angle position can be set, and therefore, the contact angle of the nip portion of the paper feeding belt 95 and the reverse roller 96 and the separation pressure corresponding thereto can be easily switched to appropriate contact angle and separation pressure.

In addition, in the present embodiment, each of the lifts L1, L2, L3 can be maintained at a certain level within the angle ranges of the four separation pressure maintaining sections Z1 to Z4 of the first cam face 61*a*, and therefore, even if the rotation angle position of the cam member 61 and the cam driving shaft 63 are abruptly changed, the application point of the paper feeding belt holder bracket 92 is not changed. Therefore, it is not necessary to strictly suppress the error of the stop position of the cam member 61, and while the component processing cost of the cam driving system from the cam driving motor 68 to the cam member 61 is reduced, the lift position of the protruding pin 92*e* can be appropriately maintained, and the contact angle and separation pressure can be controlled in a preferable manner.

As illustrated by the virtual line in FIG. 9, when the concaved cam face portions CV1 to CV4 are made in the first cam face 61*a* of the cam member 61 and second cam face 61*b* in advance, the protruding pin 92*e* can be urged in a particular rotation angle position or a region close thereto in the rotation direction of the cam member 61, and the separation pressure is unlikely to be changed during the document conveying process.

Further, for example, when a user is allowed to select the feeding condition on the screen of the operating unit 108 in such a manner that the user selects any one of multiple conditions such as setting 1, setting 2, and the like, the separation pressure can be set without complicated operation in accordance with the any given thickness of the sheet. This selection operation may be done using, for example, a selection button, and the setting value may be set according to the type of sheet such as plain paper, thick paper, coated paper, or may be set according to the type of sheet such as slippery paper, smooth paper, and the like.

When the configuration is made such that, even if the document stops due to failure in the document conveying process, the cam member 61 is rotated to sufficiently reduce or eliminate the contact pressure of the paper feeding belt 95 and the reverse roller 96, then, this can prevent excessive load from being applied to the clogged document sheet, and the damage to the document can be eliminated.

The cam driving unit 62 made into the unit can be easily detached from or slid with respect to the frame 320 of the sheet feeding unit 300, and it can be moved away from the paper feeding belt holder bracket 92 of the separation sheet feeding mechanism 9 and the paper feeding belt 95, and therefore, the maintenance work space for the paper feeding belt 95 and the reverse roller 96 can be easily ensured. In addition, the pick-up mechanism 7 and the separation sheet feeding mechanism 9 which are integrally made into the unit with the rotation driving shaft 71 can be easily detached from the frame 320 of the sheet feeding unit 300, and therefore, with regard to this point, the maintenance can also be simplified.

When the separation sheet feeding mechanism 9 is detached from the sheet feeding unit 300 during the maintenance, the reverse roller 96 can be seen easily, and this makes it easy to do replacement and the like. When the sheet feeding unit 300 is detached from the main frame of the document conveying device 52, the reverse roller 96 can be easily seen from the outside of the sheet feeding unit 300, and the maintenance work can be done easily. The separation sheet feeding mechanism 9 made into a detachable unit as the sheet feeding unit 300 can be handled in an extremely easy manner.

As described above, in the present embodiment, very small movement of the protruding pin 92*e* of the paper feeding belt holder bracket 92 during the separation sheet feeding operation is suppressed by the first cam face 61*a* and second cam face 61*b* of the cam member 61. Therefore, while the sheet conveying device employs the configuration of capable of changing the separation pressure by adjusting the contact angle at the nip portion of the paper feeding belt 95 and the reverse roller 96 with the relative displacement of the cam member 61 and the paper feeding belt holder bracket 92, the sheet conveying device can maintain appropriate contact angle during the separation sheet feeding operation, and can obtain the optimum separation pressure at all times.

In the present embodiment, the intervals in the rotation radius direction of the first cam face 61*a* and the second cam face 61*b* at multiple rotation angle positions of the cam member 61 are substantially the same interval, and therefore, when the protruding pin 92*e* of the paper feeding belt holder bracket 92 moves relatively along the first cam face 61*a* according to the rotation of the cam member 61, the floating of the protruding pin 92*e* from the first cam face 61*a* can be limited to the guide clearance range which has been set in advance.

Further, in the present embodiment, the protruding pin 92*e* of the paper feeding belt holder bracket 92 is inserted into the circular cam groove portion 61*c* of the cam member 61 so that it is positioned between the first cam face 61*a* and the second cam face 61*b* in the rotation radius direction, and therefore, very small movement of the protruding pin 92*e* of the paper feeding belt holder bracket 92 can be appropriately suppressed by the first and second cam faces of the cam member 61 during the separation sheet feeding operation.

In addition, the protruding pin 92*e* of the paper feeding belt holder bracket 92 is the protruding unit provided to protrude to the cam member 61 from the paper feeding belt holder bracket 92 holding the paper feeding belt 95 so as to allow feeding operation, and the protruding pin 92*e* is inserted between the first cam face 61*a* and the second cam face 61*b* of the cam member 61, and therefore, very small movement of the protruding pin 92*e* of the paper feeding belt holder bracket 92 can be appropriately suppressed by the first cam face 61*a* and second cam face 61*b* of the cam member 61 during the separation sheet feeding operation.

In the digital MFP 50 of the present embodiment, using the relative displacement of the cam member 61 and the paper feeding belt holder bracket 92, the contact angle of the nip portion of the paper feeding belt 95 and the reverse roller 96 is adjusted to change the separation pressure, and in addition, very small movement of the protruding pin 92*e* of the paper feeding belt holder bracket 92 can be suppressed by the first cam face 61*a* and second cam face 61*b* of the cam member 61 during the separation sheet feeding operation. Therefore, the image forming apparatus can maintain the contact angle of the nit portion of the paper feeding belt 95 and the reverse roller 96 at an appropriate level during the separation sheet feeding operation, and the document 1 which is to be fed with the optimum separation pressure at all times and can convey appropriately the document 1 to the document image scanning position, thus having superior document conveying performance.

In the above embodiment, the first cam face 61*a* and the second cam face 61*b* have tube-like surfaces parallel to each other having lines as generating lines. Alternatively, the first cam face may have stepped cam face shape, in which the lifts are different according to the axial direction positions, or the generating line may be bent gently. When the contact unit is in a stepped shape, a shaft bearing element allowing slipping in the rotation direction just like the cylindrical roller 92*f* may be interposed between the first contact unit in contact with the first cam face and the second contact unit in contact with the second cam face.

The cam member of the present embodiment may be made of a single member such as the cam member 61. Alternatively, it may include first and second cam members (multiple cam members) arranged on the same rotation center axis.

As explained above, the present invention, during the separation sheet feeding operation, very small movement of the contact unit of the cam follower member can be effectively suppressed from both sides in the rotation radius direction of the cam member using the first and second cam faces. Therefore, the sheet conveying device and the image forming apparatus can be provided, which employs the configuration of changing the separation performance by adjusting the nip portion of the contact angle of the paper feeding belt and the separation roller with the relative displacement of the cam member and the cam follower member, but capable of obtaining preferable separation performance at all times by maintaining preferable contact angle during the separation sheet feeding operation thereof. The present invention as described above is useful for sheet conveying devices and image forming apparatuses using them in general which are suitable for document conveying devices for conveying document sheets to a image scanning position.

According to the present invention, the contact unit of the cam follower member is guided by the cam member of the adjustment mechanism to the lift position in accordance with the rotation angle position of the cam member from both sides in the rotation radius direction of the cam member, and therefore, during the separation sheet feeding operation, very small movement of the contact unit of the cam follower member can be effectively suppressed from both sides in the rotation radius direction of the cam member using the first and second cam faces. As a result, the sheet conveying device and the image forming apparatus can be provided such that even though the sheet conveying device and the image forming apparatus employs the configuration for changing the separation performance by adjusting the contact angle of the nip portion of the paper feeding belt and the separation roller by relative displacement of the cam member and the cam follower member, the contact angle is preferably maintained during the separation sheet feeding operation, and the optimum separation performance can be obtained at all times. The cam member as referred to in the present embodiment may be a single member or multiple cam members arranged on the same rotation center axis.

When the contact unit of the cam follower member relatively moves along the first cam face in accordance with the rotation of the cam member, the second cam face limits the floating of the control unit from the first cam face to a clearance range which has been set in advance. It should be noted that the second cam face is preferably formed such that, when the contact unit moves along the first cam face, the second cam face is formed along an envelope always in contact with the contact unit from the opposite side to the first cam face in the rotation radius direction.

Very small change of the contact unit of the cam follower member can be appropriately suppressed by the first and second cam faces of the cam member during the separation sheet feeding operation. It should be noted that the rotation radius of the first cam face according to the rotation angle position of the cam member is less than the rotation radius of the second cam face according to the rotation angle position of the cam member, and the first cam face and the second cam face are more preferably formed in parallel with the rotation center axis of the cam member.

Very small change of the contact unit of the cam follower member can be appropriately suppressed by the first and second cam faces of the cam member during the separation sheet feeding operation.

Change of the rotation angle position of the cam member with respect to the contact unit of the cam follower member can be effectively suppressed by the concaved cam face portion, and the separation performance of the separation roller is preferably maintained.

Even if the rotation angle position of the cam member is changed with respect to the contact unit of the cam follower member, the lift of the contact unit on the first cam face can be maintained at a certain level, and the separation performance of the separation roller is preferably maintained. More specifically, even if the shaft driving the cam member rotates relatively with respect to the contact unit, the application point of the force in the rotation radius direction and the lift of the cam member with respect to the contact unit of the cam follower member are not changed substantially.

The adjustment mechanism provided at one side of the paper feeding belt can be easily detached from the separation sheet feeding driving source, and it is easy arrange the adjustment mechanism and ensure the work space therefor.

The cam member and the cam follower member can be detached and reconnected easily, and this makes it easy to maintain the paper feeding belt and the adjustment mechanism.

The separation sheet feeding mechanism made into a detachable unit can be handled in an extremely easy manner.

Even though the image forming apparatus of the present invention having the above configuration employs the configuration for changing the separation performance by adjusting the contact angle of the nip portion of the paper feeding belt and the separation roller by relative displacement of the cam member and the cam follower member, very small change of the contact unit of the cam follower member can be suppressed by the first and second cam faces of the cam member of the adjustment mechanism during the separation sheet feeding operation. Therefore, the image forming apparatus is such that the contact angle of the nip portion of the paper feeding belt and the separation roller can be maintained in a preferable manner during the separation sheet feeding operation, and the document which is to be fed can appropriately conveyed to the document image scanning position with the optimum separation pressure at all times, and thus, the image forming apparatus has superior document conveying performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a separation sheet feeding mechanism having a paper feeding belt and a separation roller, when there are not only a sheet which is in contact with the paper feeding belt and is to be fed but also a subsequent sheet in contact with the separation roller, the separation sheet feeding mechanism uses the feeding belt to feed the sheet which is to be fed, and uses the separation roller to separate the subsequent sheet from the sheet which is to be fed; and an adjustment mechanism that changes contact state of the paper feeding belt to the separation roller by changing relative position of the paper feeding belt and the separation roller, and changes and adjusts separation performance of the separation roller for the subsequent sheet, wherein the adjustment mechanism includes a cam follower member changing the relative position of the feeding belt and the separation roller in accordance with the rotation angle position of a rotating cam member, the cam member includes a first cam face and a second cam face which are formed at each rotation radius position in accordance with the rotation angle position, and are spaced apart in the rotation radius direction, and the cam follower member has a contact unit guided by the first cam face and the second cam face to a lift position in accordance with a rotation angle position of the cam member from both sides in the rotation radius direction.

2. The sheet conveying device according to claim 1, wherein intervals between the first cam face and the second cam face in the rotation radius direction at multi rotation angle positions of the cam member are substantially the same interval.

3. The sheet conveying device according to claim 1, wherein the cam member includes a circular cam groove portion in which the first cam face and the second cam face are side surfaces at both sides in the rotation radius direction, and the contact unit of the cam follower member is arranged between the first cam face and the second cam face in the rotation radius direction.

4. The sheet conveying device according to claim 3, wherein the contact unit of the cam follower member is a protruding unit provided on a paper feeding belt holder holding the paper feeding belt to allow feeding operation, and the contact unit protrudes therefrom to the cam member, wherein the protruding unit is inserted between the first cam face and the second cam face of the cam member.

5. The sheet conveying device according to claim 1, wherein the first cam face of the cam member has a concaved cam face portion that comes into contact with the contact unit of the cam follower member from both sides in the rotation direction within a particular rotation angle range, and can suppress change of the rotation angle position of the cam member with respect to the contact unit of the cam follower member.

6. The sheet conveying device according to claim 1, wherein the first cam face of the cam member includes a cam face portion in an arc shape capable of holding a lift of the contact unit on the first cam face at a certain level even when the cam member rotates within a rotation angle change range which is set in advance.

7. The sheet conveying device according to claim 1, wherein a cam driving source for rotating and driving the cam member is provided at one side of the paper feeding belt in a rotation center axial direction of the cam member, and a separation sheet feeding driving source for driving the separation sheet feeding mechanism is provided at the other side of the paper feeding belt in the rotation center axial direction of the cam member.

8. The sheet conveying device according to claim 1, wherein the cam member can move in the rotation center axial direction of the cam member with respect to the contact unit of the cam follower member, and can move to a contact position where the cam member is in contact with the contact unit of the cam follower member and a separation position where the cam member is in away from the contact unit of the cam follower member.

9. The sheet conveying device according to claim 8, wherein the separation sheet feeding mechanism is configured as a detachable unit that can be detached from an apparatus main body when the cam member is at the separation position.

10. An image forming apparatus comprising the sheet conveying device according to claim 1 as a document conveying device, and uses the document conveying device to convey a sheet serving as a document to a document image scanning position.

* * * * *